US006354062B1

(12) United States Patent
Haughton et al.

(10) Patent No.: US 6,354,062 B1
(45) Date of Patent: Mar. 12, 2002

(54) METHOD OF MANUFACTURE OF INDIVIDUAL BEVERAGE CARTON WITH A STRAW THEREIN

(75) Inventors: Keith Louis Haughton, Midland; Glenn Wallace Haughton, Toronto; Peter Christopher Michael Hillar, Stouffville, all of (CA)

(73) Assignee: BevTek Inc., Grand Cayman (KY)

( * ) Notice: Subject to any disclaimer, the term of this patent is extended or adjusted under 35 U.S.C. 154(b) by 0 days.

(21) Appl. No.: 09/712,965

(22) Filed: Nov. 16, 2000

Related U.S. Application Data

(63) Continuation of application No. PCT/CA99/00400, filed on May 13, 1999, and a continuation of application No. 09/401,314, filed on Sep. 23, 1999.

(51) Int. Cl.[7] ..... B65B 9/20; B65B 61/20

(52) U.S. Cl. ..... 53/410; 53/451; 53/474; 53/133.1; 53/551

(58) Field of Search ..... 53/410, 451, 474, 53/551, 133.1, 133.2, 239

(56) References Cited

U.S. PATENT DOCUMENTS

| | | | | |
|---|---|---|---|---|
| 2,800,265 A | | 7/1957 | Pugh, Sr. | |
| 2,844,267 A | | 7/1958 | Petriccione | |
| 3,038,281 A | * | 6/1962 | Quisel | 53/474 |
| 3,074,610 A | | 1/1963 | Pugh | |
| 3,240,415 A | * | 3/1966 | Pugh | 229/103.1 |
| 3,303,984 A | | 2/1967 | Jurena | |
| 3,303,985 A | | 2/1967 | Prokes et al. | |
| 3,325,076 A | | 6/1967 | Soucy | |
| 3,397,830 A | | 8/1968 | Chang | |
| 3,462,061 A | | 8/1969 | Shore | |
| 3,486,679 A | | 12/1969 | Pfahler | |
| 3,559,868 A | | 2/1971 | Chang | |
| 3,717,476 A | | 2/1973 | Harvey | |
| 4,126,263 A | | 11/1978 | Martensson | |
| 4,134,247 A | * | 1/1979 | Sather | 53/239 |
| 4,194,674 A | | 3/1980 | Pearson | |
| 4,225,556 A | | 9/1980 | Lothman et al. | |
| 4,267,957 A | | 5/1981 | Holmstrom | |
| 4,293,369 A | | 10/1981 | Dilot et al. | |
| 4,294,362 A | | 10/1981 | Martensson | |
| 4,301,927 A | | 11/1981 | Carlsson et al. | |
| 4,312,450 A | | 1/1982 | Reil | |
| 4,331,288 A | | 5/1982 | Lothman | |
| 4,343,402 A | | 8/1982 | Holmstrom | |
| 4,345,415 A | | 8/1982 | Jarund | |
| 4,367,828 A | | 1/1983 | Reil | |
| 4,387,547 A | | 6/1983 | Reil | |
| 4,391,385 A | | 7/1983 | Rausing | |
| 4,410,128 A | | 10/1983 | Rausing | |
| 4,445,309 A | | 5/1984 | Reil | |
| 4,462,202 A | | 7/1984 | Reil | |

(List continued on next page.)

*Primary Examiner*—John Sipos
(74) *Attorney, Agent, or Firm*—Nancy E. Hill; Hill & Schumacher

(57) ABSTRACT

A method of manufacturing a liquid container of plastic coated boxboard, laminated cardboard or the like having a straw therein is disclosed. A method for attaching a holder/straw assembly to a carton in a continuous form, fill and seal process including the following steps: unrolling a rolled sheet material being comprised of a plurality of carton sections, each carton section having a hole formed therein; sealingly attaching the holder/straw assembly to the sheet material over said hole; attaching a strip to the holder/straw assembly; forming the sheet into a columnar sleeve; sealing a longitudinal seal along the columnar sleeve; adding the beverage into the sealed columnar sleeve; forming a top and bottom transverse seal across the columnar sleeve and through the beverage; cutting each carton from the columnar sleeve; and forming a parallelepipedic carton having a drinking straw therein.

35 Claims, 40 Drawing Sheets

U.S. PATENT DOCUMENTS 4,464,156 A 8/1984 Homstrom
4,526,314 A 7/1985 Reil
4,528,803 A 7/1985 Ott
4,546,592 A 10/1985 Reil
4,570,788 A 2/1986 Lindsjo
4,604,850 A 8/1986 Reil
4,606,174 A 8/1986 Berg
4,614,074 A * 9/1986 Evers ..... 53/410
4,617,779 A 10/1986 Nygren et al.
4,718,598 A 1/1988 Pupp et al.
4,747,253 A 5/1988 Schulte
4,798,295 A 1/1989 Rausing
4,798,296 A 1/1989 Lagerstedt et al.
4,804,134 A 2/1989 Reil
4,828,138 A 5/1989 Andersson
4,848,063 A 7/1989 Niske
4,861,328 A 8/1989 Franke et al.
4,903,458 A * 2/1990 Hakansson ..... 53/133.1
4,986,859 A 1/1991 Watanabe
5,000,337 A 3/1991 Im
5,067,311 A 11/1991 Andersson
5,068,005 A 11/1991 Lindskog et al.
5,101,999 A 4/1992 Robichaud et al.
5,116,105 A 5/1992 Hong
5,148,971 A 9/1992 Ahn
5,158,633 A 10/1992 Rausing
5,188,283 A 2/1993 Gu
5,482,202 A 1/1996 Wen
5,758,473 A * 6/1998 Patelli ..... 53/133.1
5,832,698 A * 11/1998 Huguenin ..... 53/451
6,076,729 A * 6/2000 Cornell et al. ..... 229/103.1

* cited by examiner

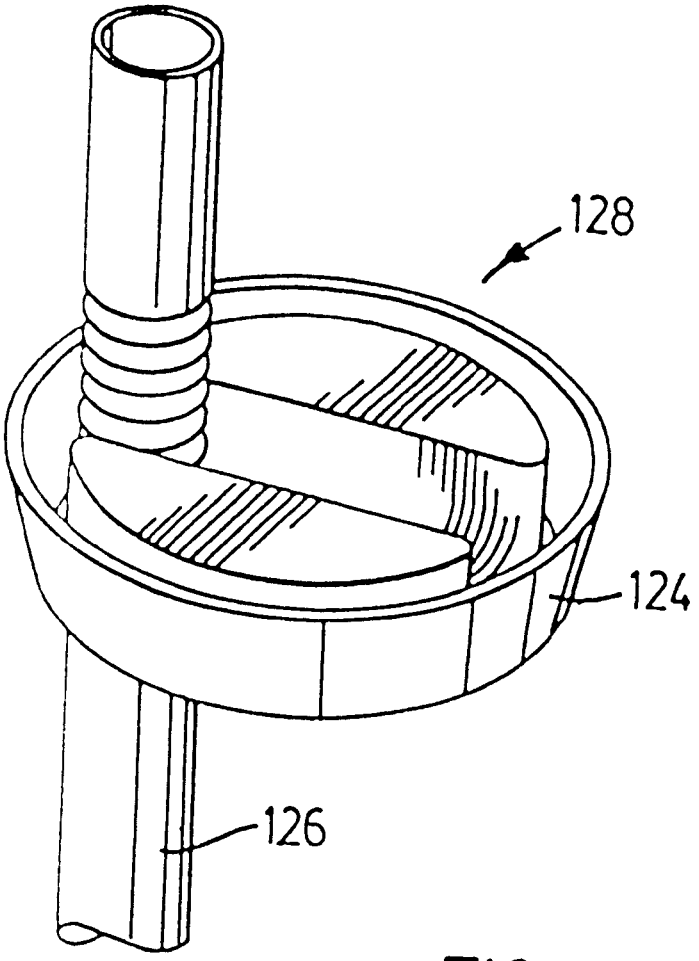
FIG.23
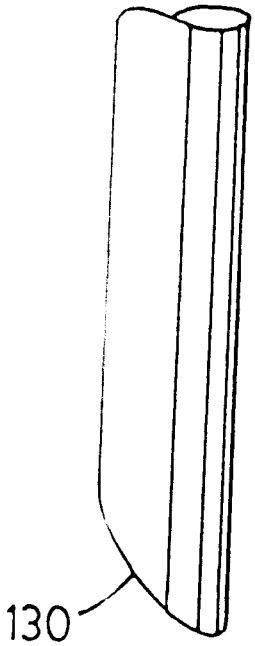

METHOD OF MANUFACTURE OF INDIVIDUAL BEVERAGE CARTON WITH A STRAW THEREIN

CROSS REFERENCE TO RELATED PATENT APPLICATION

This patent application is a continuation of Patent Cooperation Treaty application PCT/CA99/00400 which designates the United States and was filed May 13, 1999 and entitled STOPPERS FOR INDIVIDUAL BEVERAGE CONTAINERS and continuation of U.S. application Ser. No. 09/401,314 filed Sep. 23, 1999 and entitled INDIVIDUAL BEVERAGE CARTON WITH A STRAW THEREIN AND A METHOD OF MANUFACTURE.

FIELD OF THE INVENTION

The present invention relates generally to the provision of a drinking straw with an individual beverage carton and in particular to the provision of a drinking straw on the inside of an individual beverage carton and a method of manufacture thereof.

BACKGROUND OF THE INVENTION

Packaged individual beverage cartons of plastic coated paper board sheet material folded into a generally parallelepipedic shape have been made available to consumers for many years and are often referred to as "juice boxes".

Various arrangements have been proposed to provide a straw with an individual beverage carton. In general, a cylindrical plastic drinking straw is packaged in a separate sealed plastic envelope and attached usually with an adhesive to the outside of the beverage carton. The straw may be straight or it may have an accordion type bend therein. In use, the consumer is required to remove the drinking straw from its envelope and insert it through the packaging of the container at a predetermined place usually on the top of the container, the straw then being ready to allow consumption of the beverage from the container. As the drinking straw once inserted into the beverage carton makes consumption of the beverage possible, conversely consumption of the beverage from the container without the use of the drinking straw is problematic and objectionable.

One disadvantage of the assembly as described above is that the straw has to be inserted into the beverage carton prior to use. In order to insert the drinking straw into the beverage carton the consumer has to pierce a portion of the carton. Typically there is a preferred point of entry or insertion point that can be identified by a round hole in the carton (but not in the foil liner) on its top. However, the consumer has to puncture the foil liner so that the straw has access to the liquid therein. The foil liner can withstand relatively high pressures such that the carton will not readily leak at the insertion point. As the act of inserting the drinking straw through the packaging material at the predetermined place requires considerable force, the beverage carton also needs to be simultaneously held soundly. This holding soundly often means squeezing the beverage carton and therefore there exists the risk that beverage will rapidly vacate the beverage carton either up the straw or around the straw at the insertion point upon insertion, thereby causing the beverage to be spilled. The consumer is at risk of spilling the beverage on themselves or someone or something at hand. This risk is further increased by the fact that a high percentage of these beverages are consumed by children, individuals that may lack some degree of hand coordination or who may consider the spraying of liquid desirable. This, of course, is not desirable or a game to the parent.

Another disadvantage of the current system of attaching the drinking straw and protective plastic envelope to the outside of the beverage carton is that the protective plastic envelope will often merely be discarded as litter. Commonly, removal of the existing drinking straw currently provided with the beverage carton of the previously mentioned type also requires removal of the straw's protective plastic envelope from the outside of the beverage carton to which it is attached when received by the consumer. This leaves the consumer in the possession of the now empty plastic envelope and due to the small size of the plastic envelope and its low weight the consumer is often tempted to discard the plastic envelope as litter. As the empty envelope is manufactured of plastic, the envelope will exist in the environment for some time before breaking down and due to its small size and low weight is not likely to be picked up as garbage.

A still further disadvantage of the current system of attaching the drinking straw and protective plastic envelope to the outside of the beverage carton is that the straw will obscure the writing and art work on one side of the carton. In addition, as the plastic envelope containing the drinking straw is attached to the outside of the beverage carton there exists considerable risk that the plastic envelope and drinking straw will be inadvertently removed from the outside of the beverage carton and lost, placing the consumer in a compromised position when the time comes for the consumption of the beverage from the container.

Some arrangements have been proposed wherein a straw is provided in an individual beverage carton. For example U.S. Pat. No. 5,188,283 issued to Gu on Feb. 23, 1993, shows a straw in four different types of containers. In the parallelepipedic shaped container there is provided a hole in the container through which the straw is positioned. A groove is provided on the inside of the top tuck flap that is in registration with a top portion of the straw when the tuck flap is sealed to the container. Another example of providing a straw in a parallelepipedic shaped container is shown in U.S. Pat. No. 5,482,202 issued to Wen on Jan. 9, 1996. This container has a straw that is attached in the seams of the container and in at least one embodiment the straw extends from a top side edge to the opposed bottom side edge. An alternate approach is shown in U.S. Pat. No. 5,1116,105 issued to Hong on May 26, 1992. This container has a short straw or pipette attached to the underside of the top tuck flap which is the extension of the top seam. The short straw is less than half the width of the container and is used more as a pouring spout than a drinking straw. The short straw is on the outside of the container and has to be inserted through the side wall of the container.

Each of these examples of a straw provided in an individual beverage container suffers from disadvantages. The Gu container would be difficult to manufacture. Firstly, the groove would be difficult to form in the top tuck flap. Secondly the top tuck flap with the groove therein would be difficult to seal once the container is filled with liquid. Thirdly the straw, hole and groove arrangement would not be adaptable to the continuous form, fill and seal process that is preferred for the manufacture of parallelepipedic shaped containers. The Wen container similarly would not be adaptable to the continuous form, fill and seal process since a good seal in a seam having a straw therein would be difficult to achieve. Further, a straw in the seam might lead to leakage through the straw. The Hong container provides a pour spout but does not eliminate the necessity of the consumer having to push the short straw or pipette into the container with all of the disadvantages associated therewith and it also has the disadvantage described above that the straw can be easily lost.

As the preferred method of manufacture of existing parallelepipedic plastic coated paper board material beverage cartons, involves a continuous form, fill and seal process, there are limited opportunities for the application of a drinking straw on the inside of the carton, so that the drinking straw may be inside the beverage carton at the time of purchase of the beverage by the consumer.

In general, the form, fill and seal process is composed of the steps of unrolling a preprinted and precreased plastic laminated paper board sheet; forming the sheet into a columnar sleeve; sealing a longitudinal seal along the columnar sleeve; adding the beverage into the sealed columnar sleeve; forming a transverse seal across the columnar sleeve and through the beverage; cutting the package from the columnar sleeve and forming a parallelepipedic carton with folded and fixed tabs.

Accordingly it would be advantageous to process for attaching a drinking straw to an individual beverage carton such that the drinking straw is on the inside of the beverage carton.

SUMMARY OF THE INVENTION

In one aspect of the invention a method of manufacturing a liquid container of plastic coated boxboard, laminated cardboard or the like having a straw therein is disclosed. The method for attaching a holder/straw assembly to a carton in a continuous form, fill and seal process including the following steps: unrolling a rolled sheet material being comprised of a plurality of carton sections, each carton section having a hole formed therein; sealingly attaching the holder/straw assembly to the sheet material over said hole; attaching a strip to the holder/straw assembly; forming the sheet into a columnar sleeve; sealing a longitudinal seal along the columnar sleeve; adding the beverage into the sealed columnar sleeve; forming a top and bottom transverse seal across the columnar sleeve and through the beverage; cutting individual cartons from the columnar sleeve; and forming a parallelepipedic carton having a drinking straw therein.

In another aspect of the invention a sleeve form, fill and seal process of manufacturing beverage cartons having a straw/holder assembly attached thereto so as to provide a straw therein is disclosed. The method includes the following A process for attaching a holder/straw assembly to a carton in a sleeve form, fill and seal process comprising the steps of: receiving a flattened sleeve; expanding the sleeve having a hole formed therein; sealing one end of the sleeve; sealingly attaching the holder/straw assembly to the sleeve over said hole; attaching a strip to the holder/straw assembly; adding the beverage into the sealed columnar sleeve; sealing the other end of the sleeve; and forming a carton having a drinking straw therein extending from one end thereof.

Further features of the invention will be described or will become apparent in the course of the following detailed description.

BRIEF DESCRIPTION OF THE DRAWINGS

The invention will now be described by way of example only, with reference to the accompanying drawings, in which:

FIG. 23 is a perspective view of a holder of the present invention showing an alternate embodiment of an inner portion of holder having a straw integrally attached thereto;

DETAILED DESCRIPTION OF THE INVENTION

Figure 1:
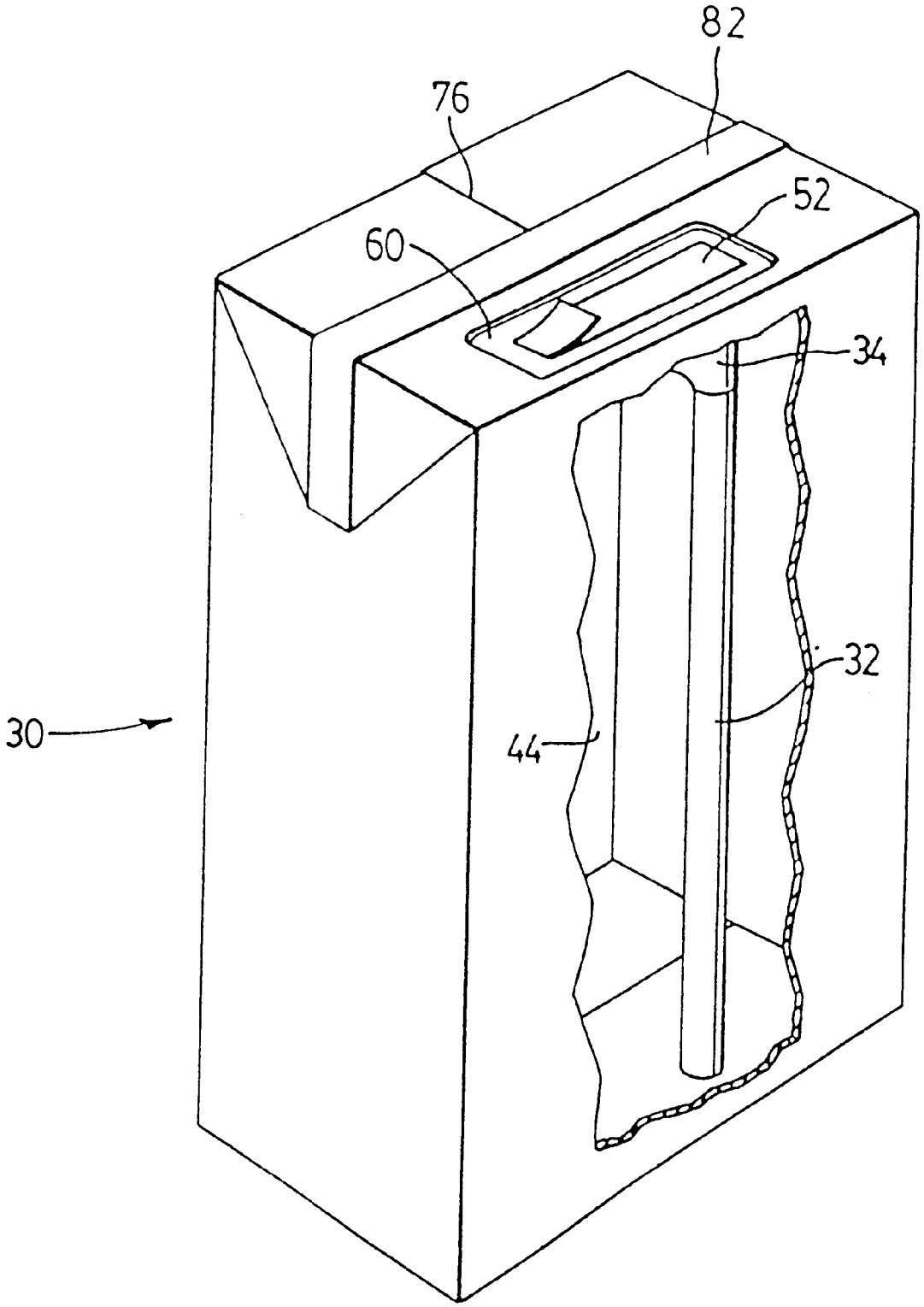
FIG. 1 is a perspective view of a carton of the present invention shown with a portion of the side panel broken away.

Referring to FIG. 1 the individual beverage carton of the present invention is shown generally at 30. The beverage carton 30 includes a straw 32, a straw holder 34 and a sealing strip 52.

Figure 2:
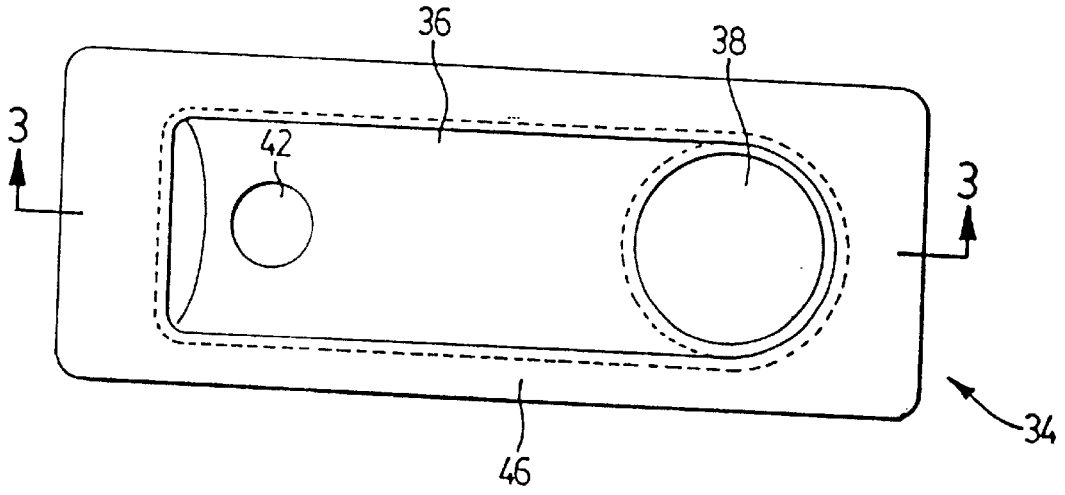
FIG. 2 is a top view of the holder of the present invention.
Figure 3:
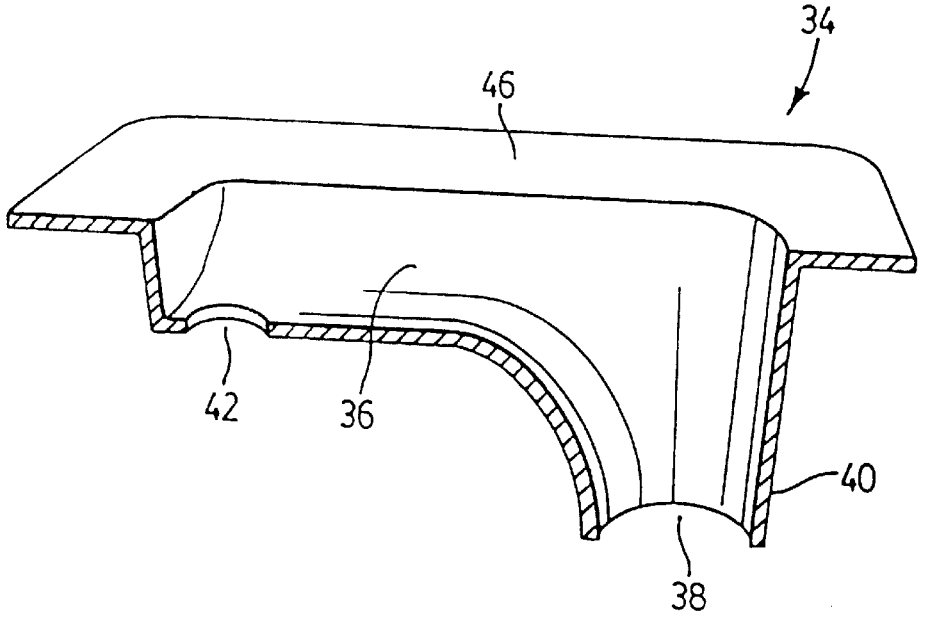
FIG. 3 is a partial perspective view of the holder, shown along the line 3—3 of FIG. 2.
Figure 4:
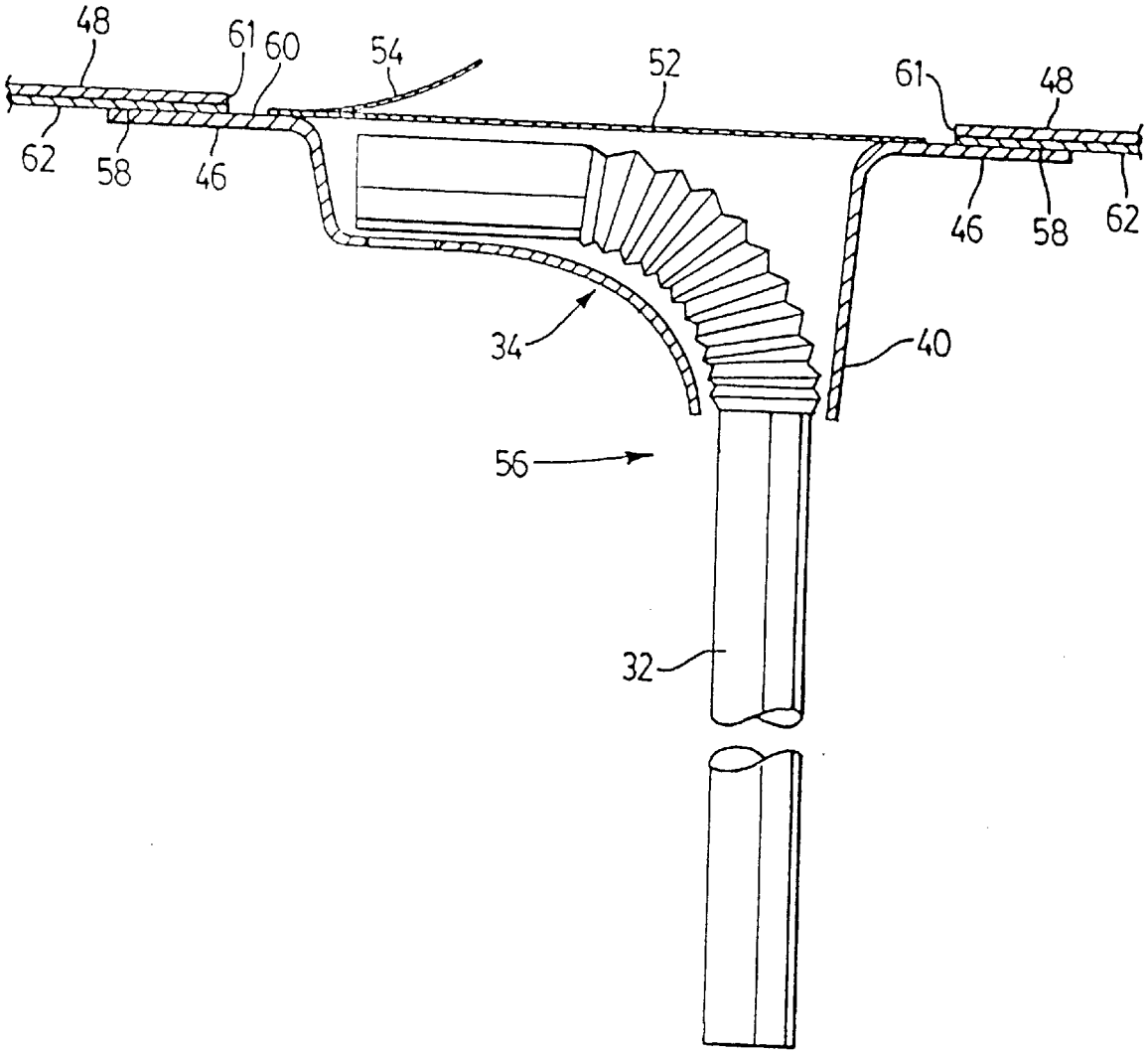
FIG. 4 is a sectional view of the assembly attached to the inner surface of the sheet material of the carton.
Figure 5:
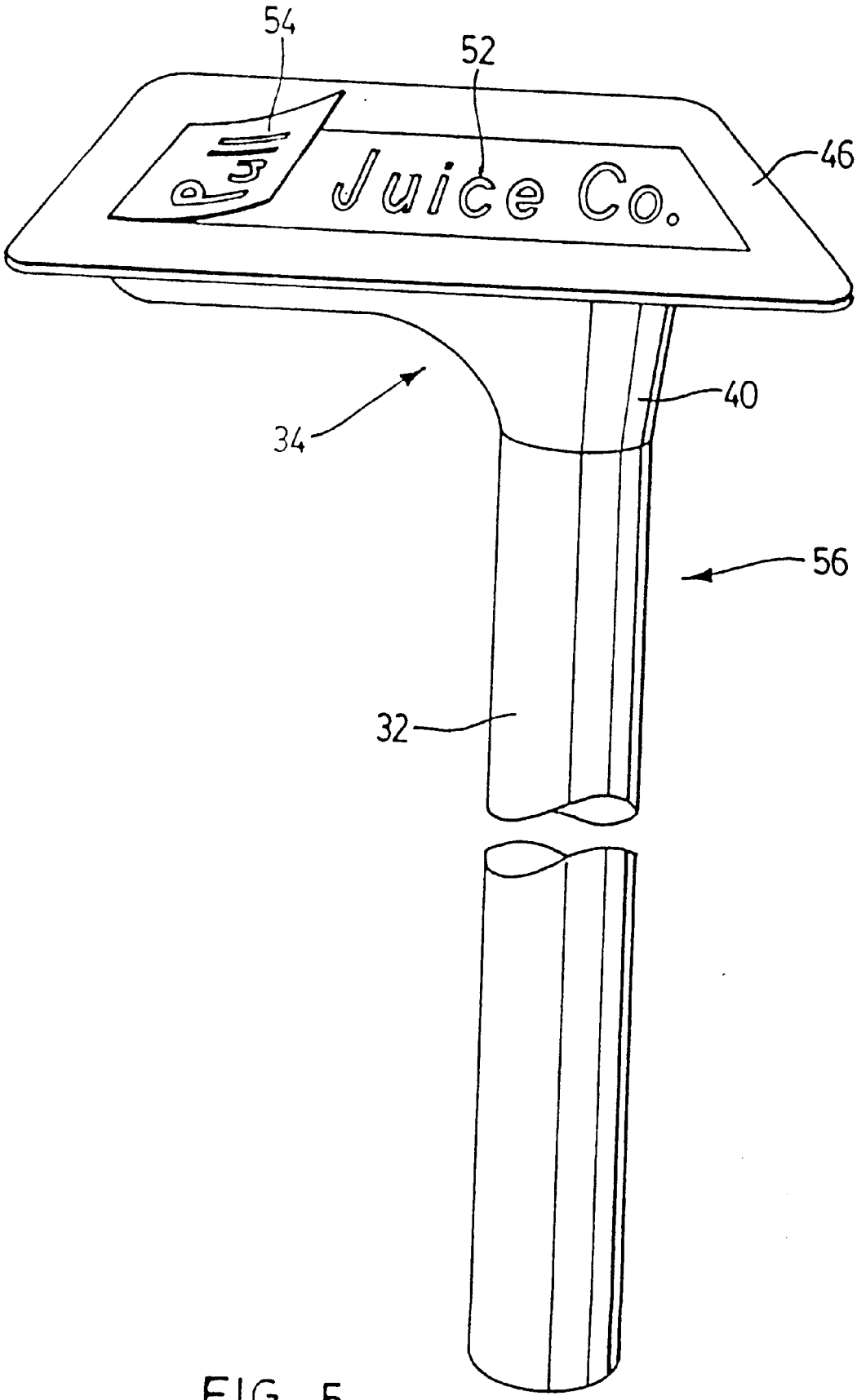
FIG. 5 is a perspective view of the holder, straw and strip assembly of the present invention.

The holder 34 for the straw 32 is shown in more detail in FIGS. 2 and 3 and with the straw 32 therein in FIGS. 4 and 5. The holder 34 has a trough 36 to accept a portion of the straw 32, an aperture 38 for the straw 32 to pass therethrough and a sleeve 40 to support the remaining portion of the straw 32. The holder 34 has a flange 46 around the perimeter of the trough 36 thereby providing a surface for attaching the holder 34 to the material 48 of the beverage carton 30.

A vent hole 42 is provided in trough 36 to allow atmospheric pressure to gain access into the beverage carton 30 to facilitate consumption of the beverage with the straw 32 by the consumer. Alternatively, the hole 42 need not be provided if there is sufficient clearance between the straw 32 and the aperture 38 of the holder 34 to allow atmospheric pressure to enter the internal volume 44 of the beverage carton 30. This allows the consumer to suck the beverage up through the straw 32 without creating a vacuum inside the beverage container 30.

Figure 7:
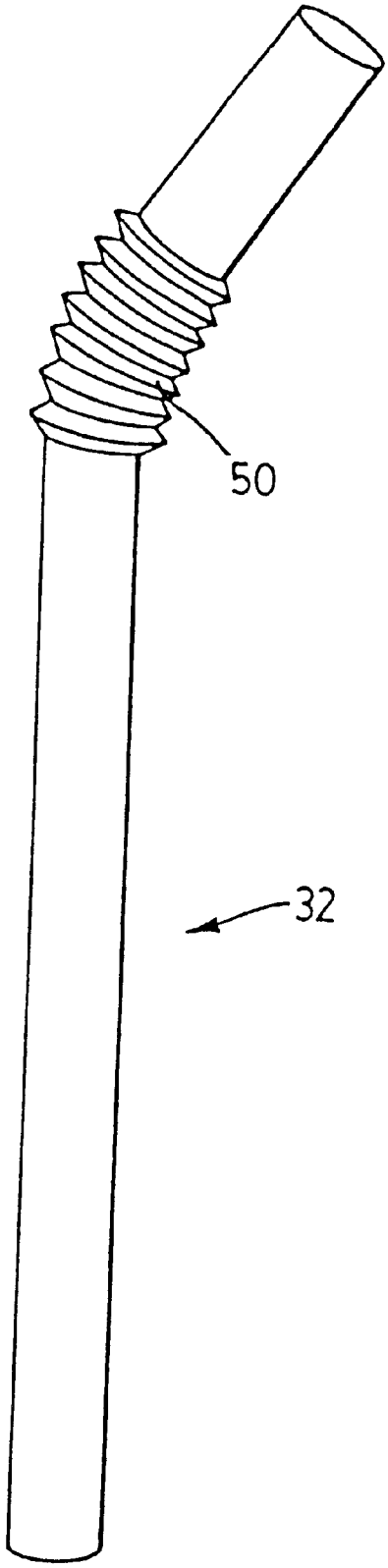
FIG. 7 is a perspective view of the drinking straw.

A drinking straw 32 as shown in FIG. 7 has a region of corrugations 50 to allow flexible manipulation of the straw 32 and to allow banding of the straw 32 without "kinking" or damaging the straw 32.

Figure 24:
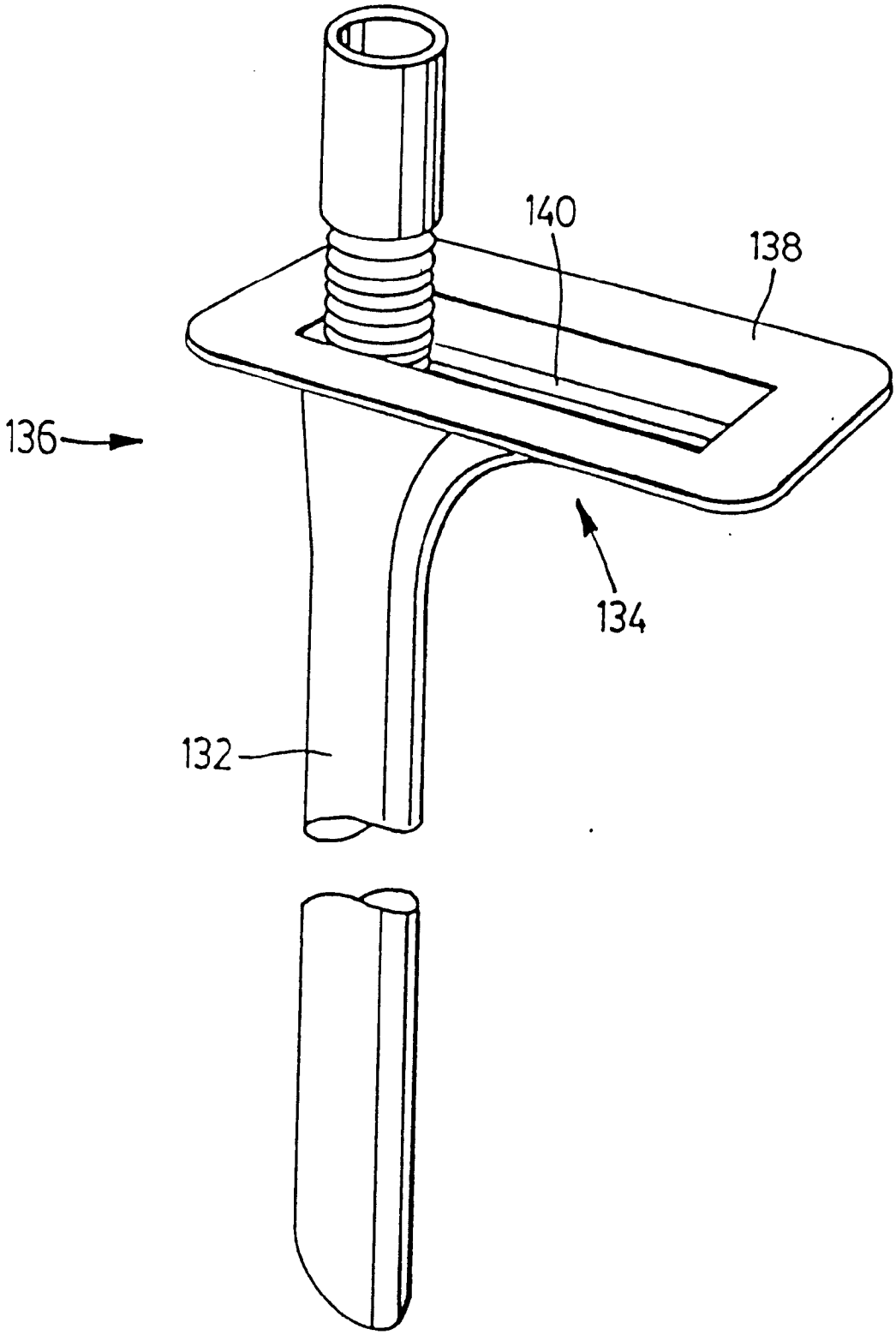
FIG. 24 is a perspective view of an alternate embodiment of the holder, straw assembly of the present invention wherein the holder and straw are integrally attached.

Referring to FIG. 24 an alternate embodiment is shown wherein the straw portion 132 and the holder portion 134 are integrally attached to form a unitary straw/holder 136. The holder portion 134 has a peripheral flange 138 to allow attachment to the material 48 and strip 52. A trough 140 is formed in the holder portion to allow the upper portion of the straw portion 132 to be stowed. A vent hole (not shown in FIG. 24) is formed in the holder portion of unitary straw/holder 136 to allow atmospheric pressure to enter the container during use. Hereinafter the preferred embodiment of the separate straw 32 and holder 34 will be discussed but it will be appreciated by those skilled in the art that straw 32 and holder 34 could be replaced by unitary straw/holder 136.

The holder 34, straw 32 and strip 52 can be preassembled as an assembly 56 shown in FIG. 5. Referring to FIG. 4, preferably, the assembly 56 is attached to the lining 62 of material 48 as described in more detail below. The assembly 56 is attached to the material 48 around the perimeter of an oblong hole 60 that has been precut in the sheet packaging material 48. The assembly 56 is attached to the lining 62 of the material 48 at the flange 46 of the holder 34 so that there is a liquid and gas tight, mechanically sound seal. For a lining 62 of plastic and a holder 34 also of similar plastic, welding may be used as the method of fastening. It will be appreciated by those skilled in the art that other types of seals may be used to achieve a liquid and gas tight seal that is mechanically sound which would be included within the scope of this invention.

FIGS. 4 and 5 illustrate the straw 32 positioned in the holder 34 and the strip 52 covering the top portion of the straw 32. The strip 52 is attached to the flange 46 of the holder 34 leaving an extent of the flange 46 uncovered around the perimeter of the strip 52. A tab 54 which is an extension of the strip 52 may be provided to facilitate removal of the strip 52 by the consumer. The attachment of the strip 52 to the flange 46 is a liquid and gas tight seal which allows for the removal of the strip 52 as the consumer peels the strip 52 off by pulling on tab 54. Preferably the inside depth of trough 36 of the holder 34 does not exceed the outside diameter of the drinking straw 32 so as to provide a straw 32 that is easily accessed upon removal of the strip 52 by the consumer. In contrast the depth of the trough 36 should not be so small that the straw 32 exerts stress on the strip 52 as it keeps the drinking straw 32 in the stowed position.

Figure 6:
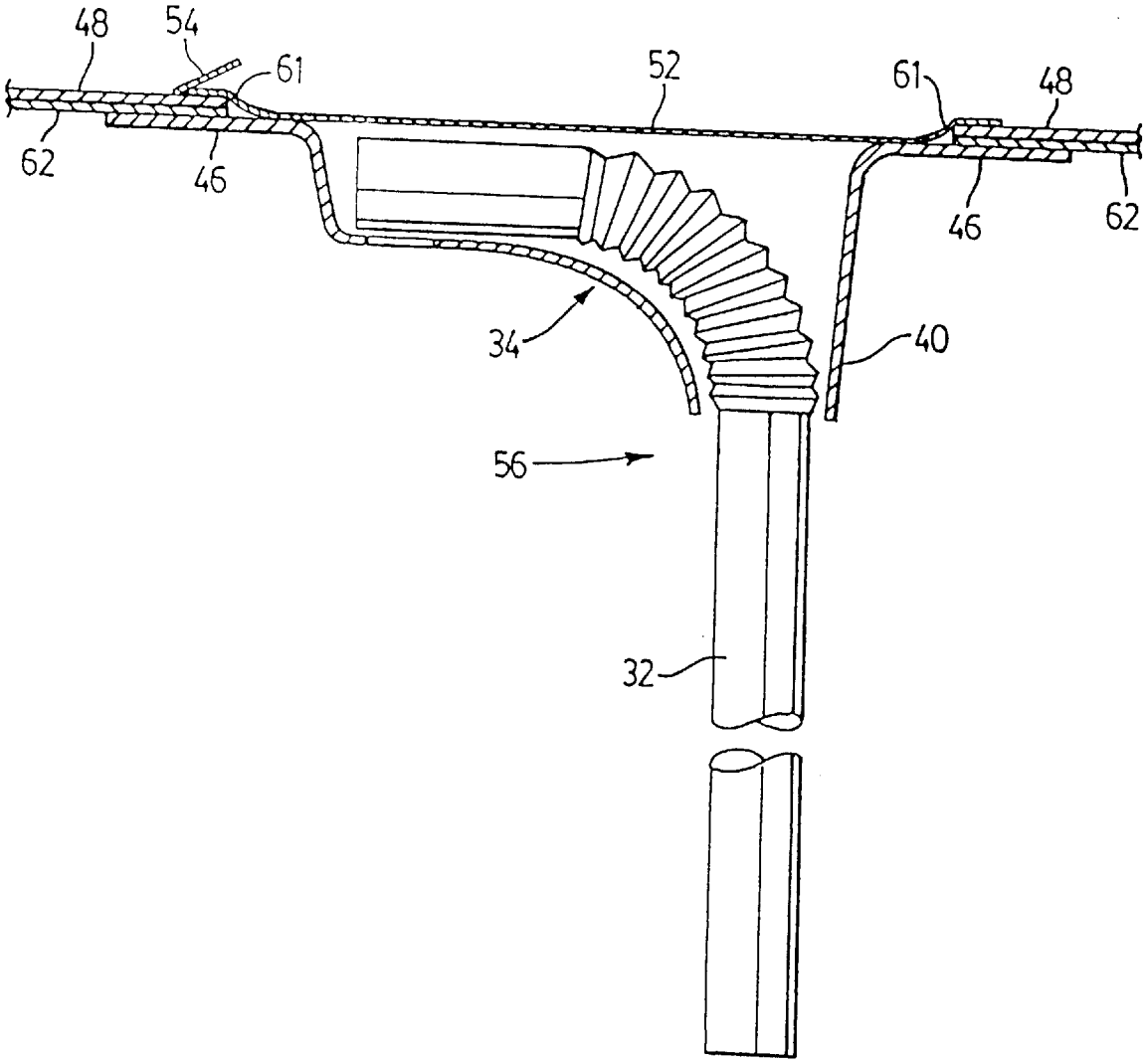
FIG. 6 is a sectional view of the assembly attached to the inner surface of the sheet material showing an alternate arrangement for the strip.

Alternatively referring to FIG. 6, the strip 52 could be applied over the trough 36 to the flange 46 of the holder 34 after the holder 34 is attached to the lining 62 of the packaging material 48 and that the strip 52 could also be applied over a portion of the outside of the packaging material 48 around the perimeter of the oblong hole 60.

Both sides of strip 52 and tab 54 may be used for advertising or promotional material or the like.

Preferably, the unsealed margin 61 of the packaging material 48 at the oblong hole 60 is not exposed to the liquid contents of the finished carton 30. Accordingly, as shown in FIG. 4 where the strip 52 is attached with a liquid and gas tight seal to the flange 46 leaving free an extent of the flange 46, margin 61 is not exposed to the liquid contents. Similarly as shown in FIG. 6 where the strip 52 is attached with a liquid and gas tight seal to the flange 46 and the material 48 margin 61 is not exposed to the liquid contents. Alternatively margin 61 may be sealed with a plastic coating or the like (not shown). A plastic seal may be attached around oblong hole 60 over flange 46, prior to attaching strip 52.

Figure 8:
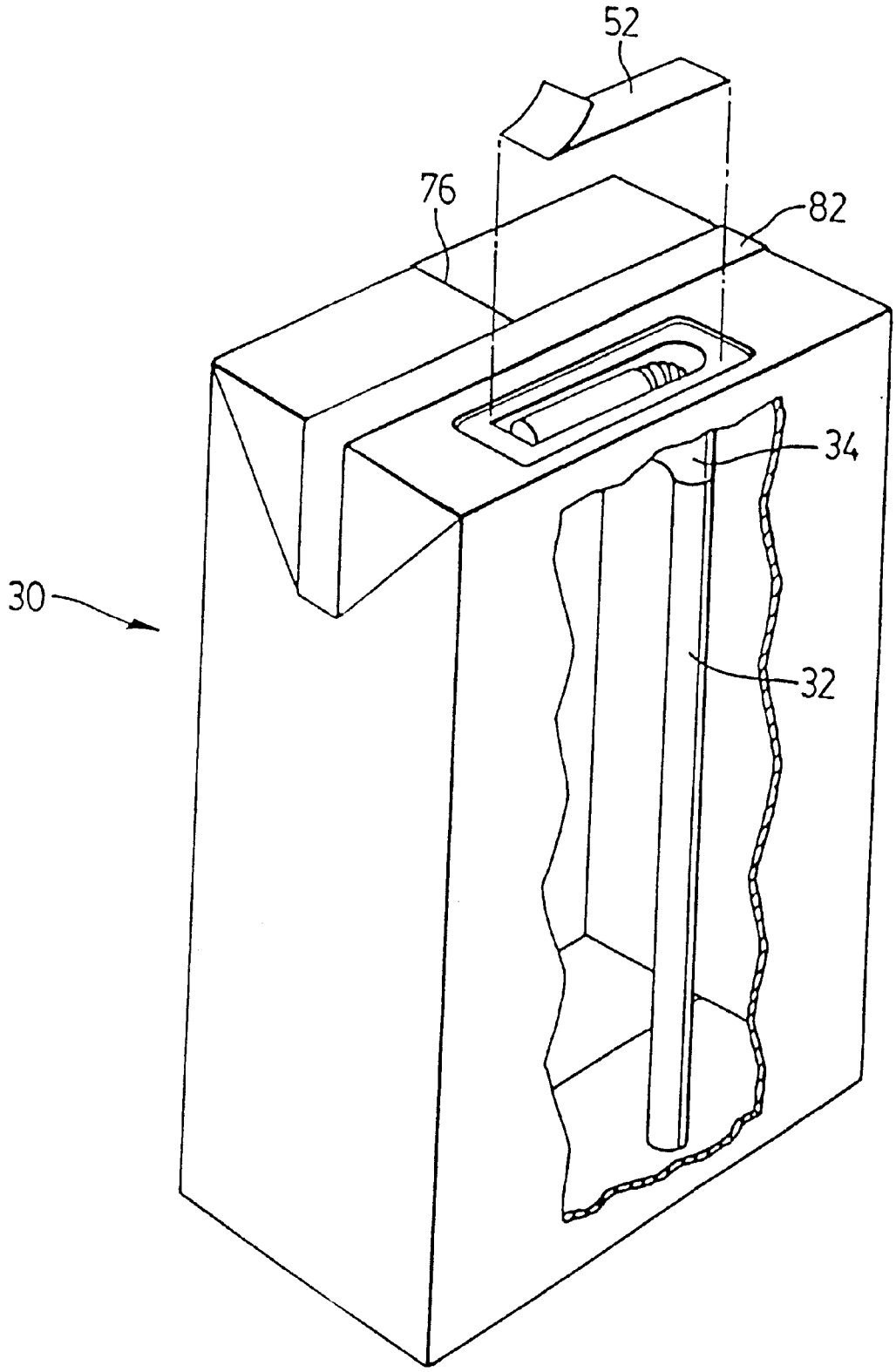
FIG. 8 is a perspective view of the carton in FIG. 1 with the strip shown exploded.
Figure 9:
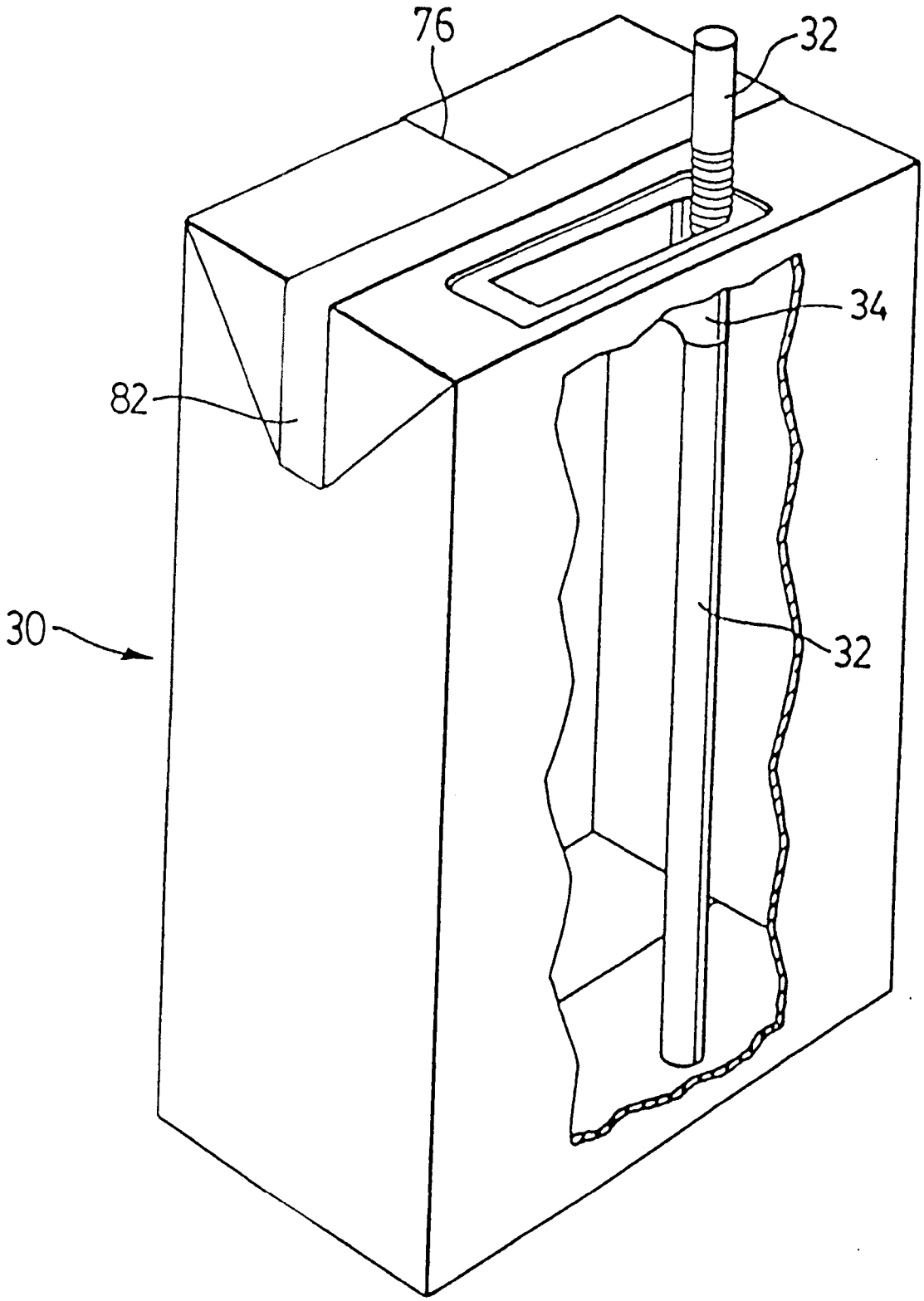
FIG. 9 is a perspective view of the carton in FIG. 1 with the strip removed and the straw raised.

FIG. 1 shows the carton 30 as the consumer would receive it, FIG. 8 shows carton 30 with the strip 52 removed and with the top portion of the straw 32 accessible but still in the stowed position and further, FIG. 9 shows the straw 32 raised into the drinking position.

Preferably the finished beverage carton 30, as shown in FIG. 1, 8 and 9 has the transverse seam 82 at the top of the carton 30 folded so that the longitudinal seam 76 is folded back on itself. This folding arrangement will allow the greatest uninterrupted width at the top of the carton 30 for the application of the assembly 56.

Figure 10:
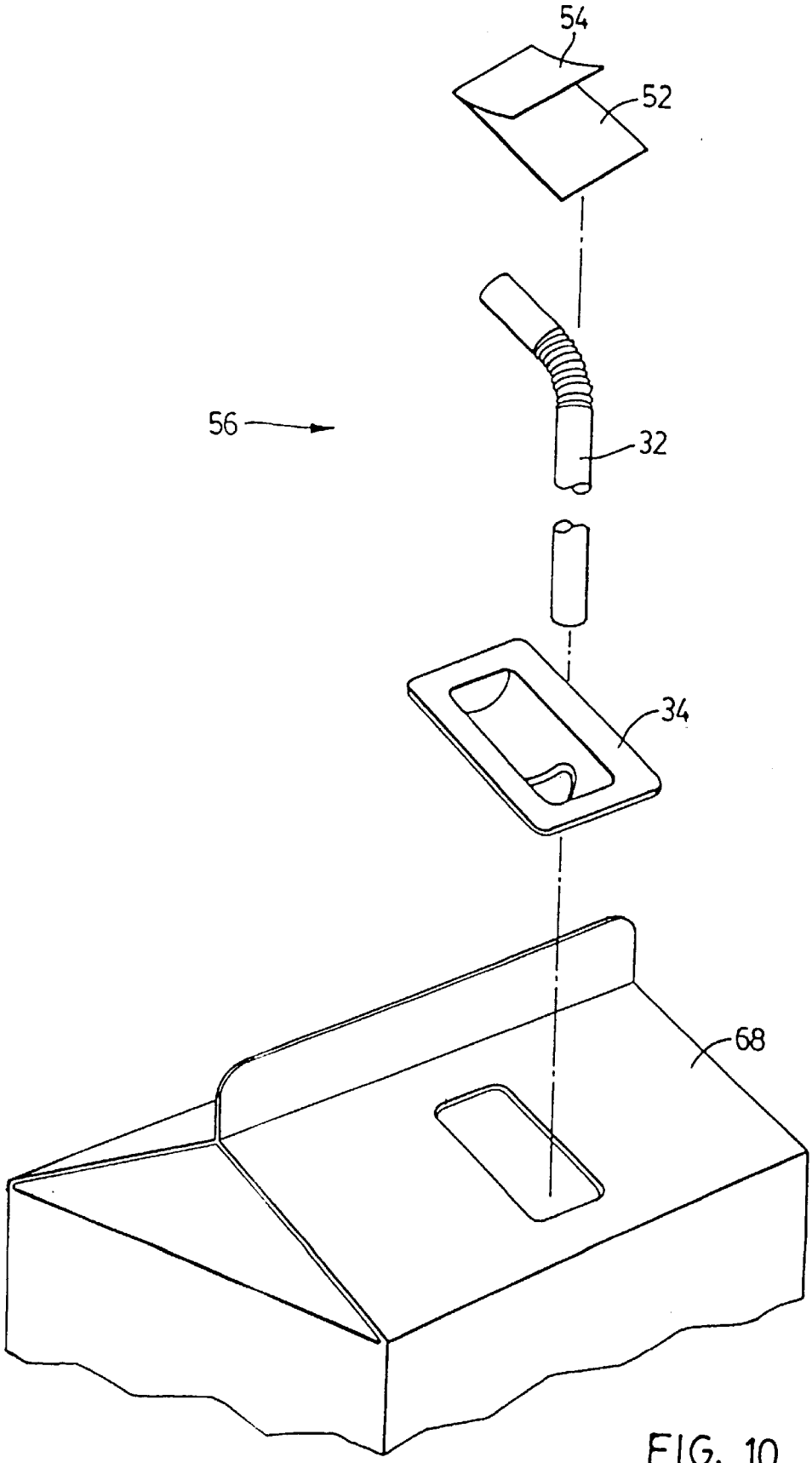
FIG. 10 is an exploded partial perspective view of the assembly of the present invention shown applied to a gable top carton.
Figure 11:
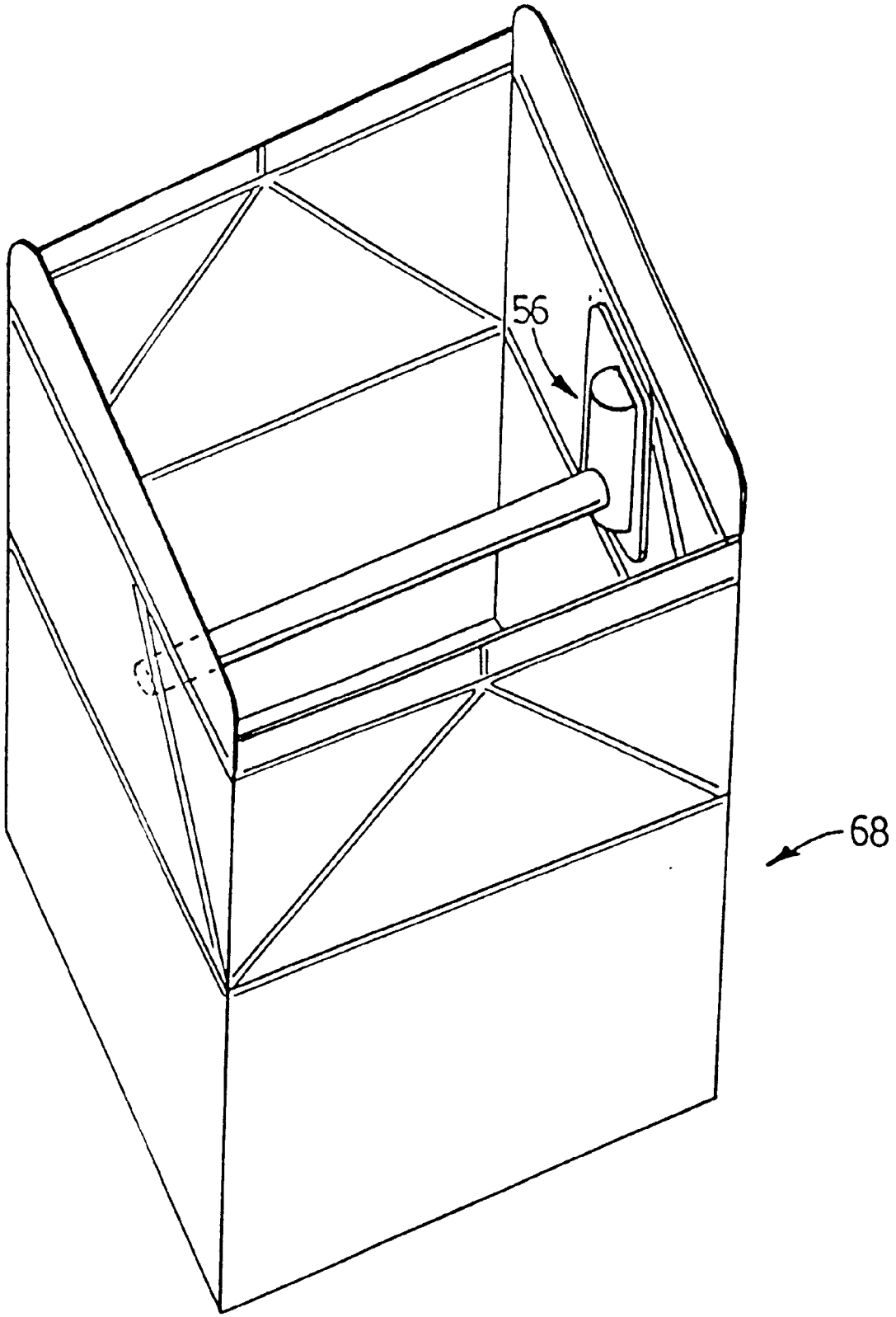
FIG. 11 is a perspective view of the assembly of the present invention shown applied to the inner surface of a partially formed gable top carton.
Figure 12:
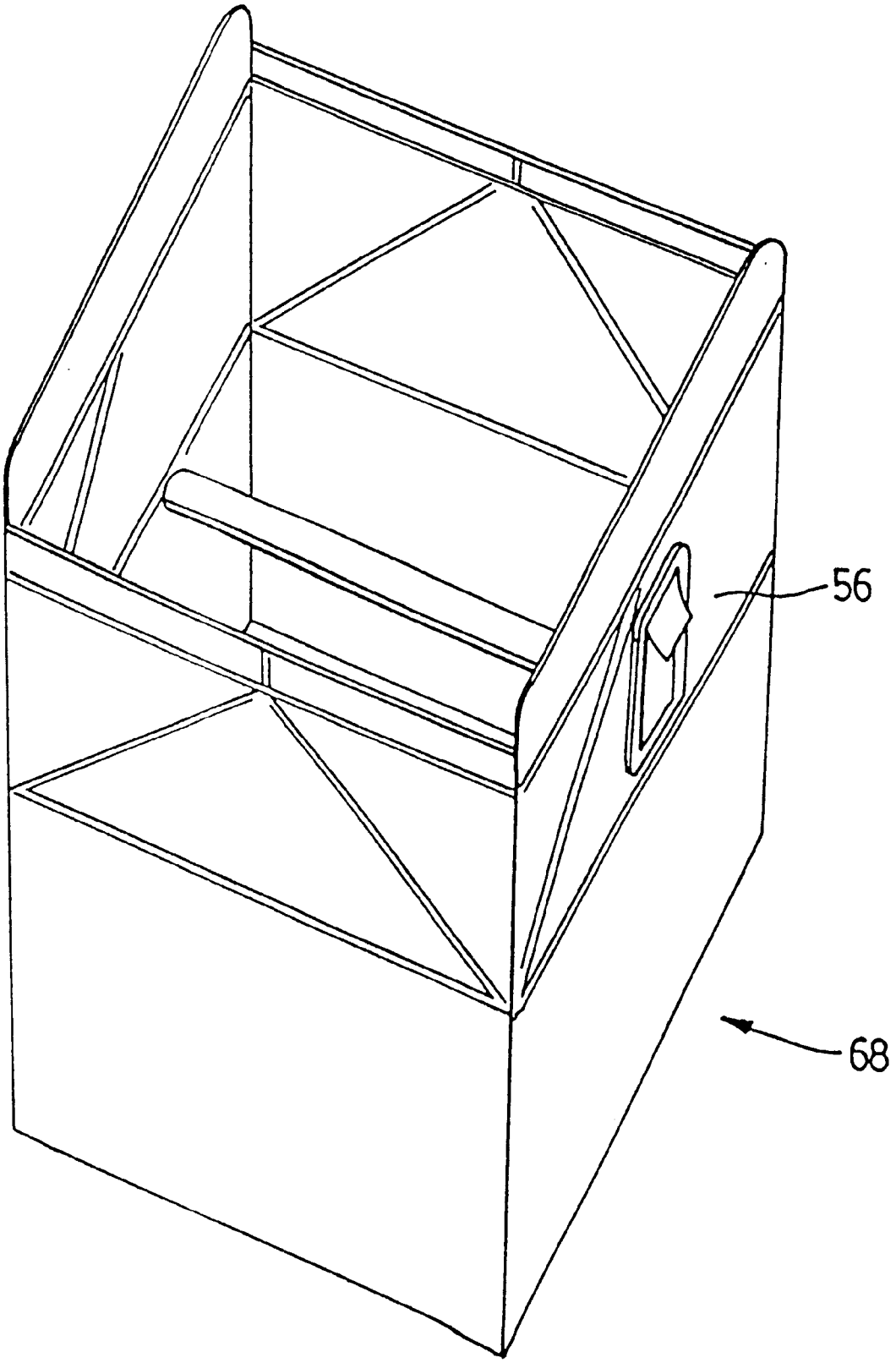
FIG. 12 is a perspective view similar to FIG. 11 but showing the assembly applied to the outer surface of a partially formed gable top carton.
Figure 13:
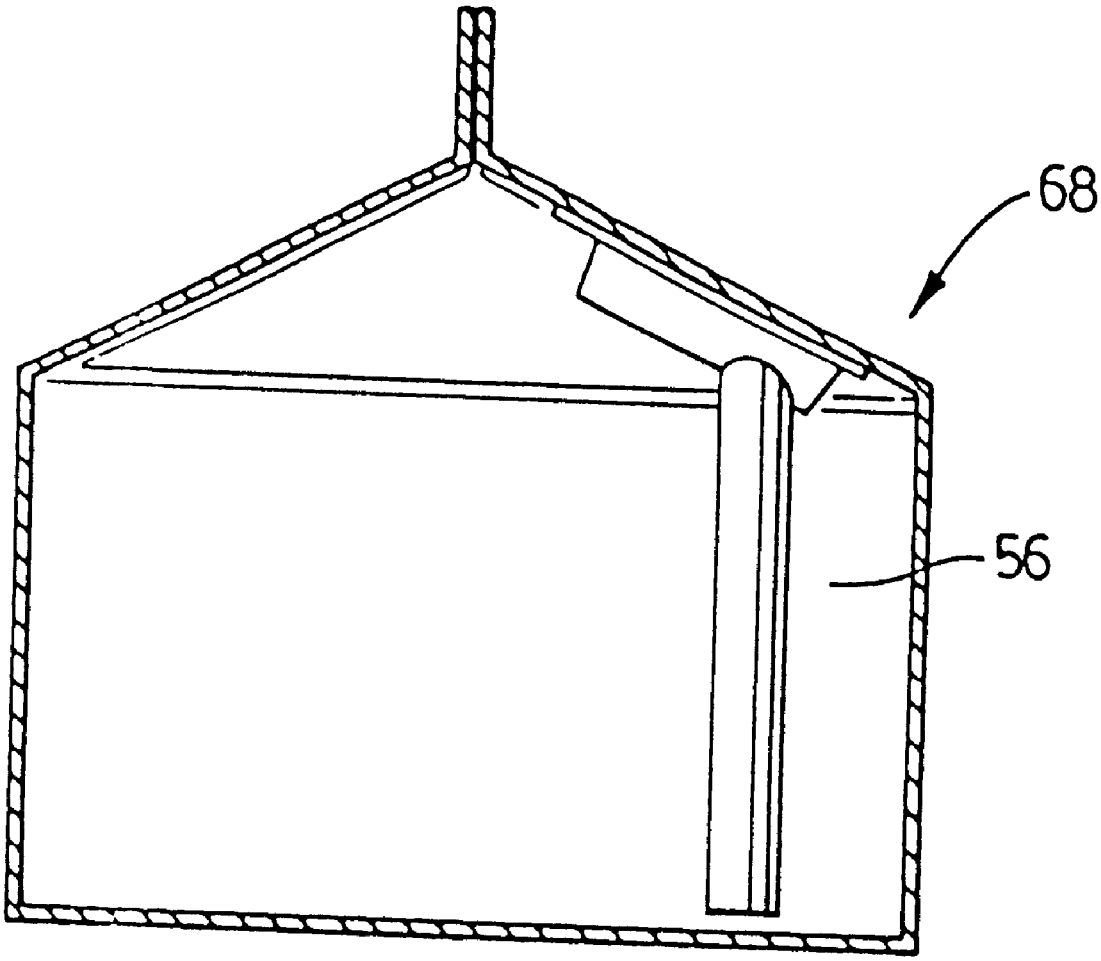
FIG. 13 is a sectional view of a gable top carton showing the assembly of the present invention attached to the inside surface of the gable top carton.

As a further application of the holder 34, straw 32 and strip 52, FIG. 10 illustrates how the assembly 56 could be adapted for a gable top carton 68. The assembly 56 could be applied to the inside of the carton 68 before the carton is filled and closed, as shown in FIG. 11 or alternatively, assembly 56 could be applied to the outside of the carton 68 before the carton is filled and closed, as shown in FIG. 12. A filled and closed carton 68 is illustrated in FIG. 13 with assembly 56 attached to the carton 68.

Figure 20:
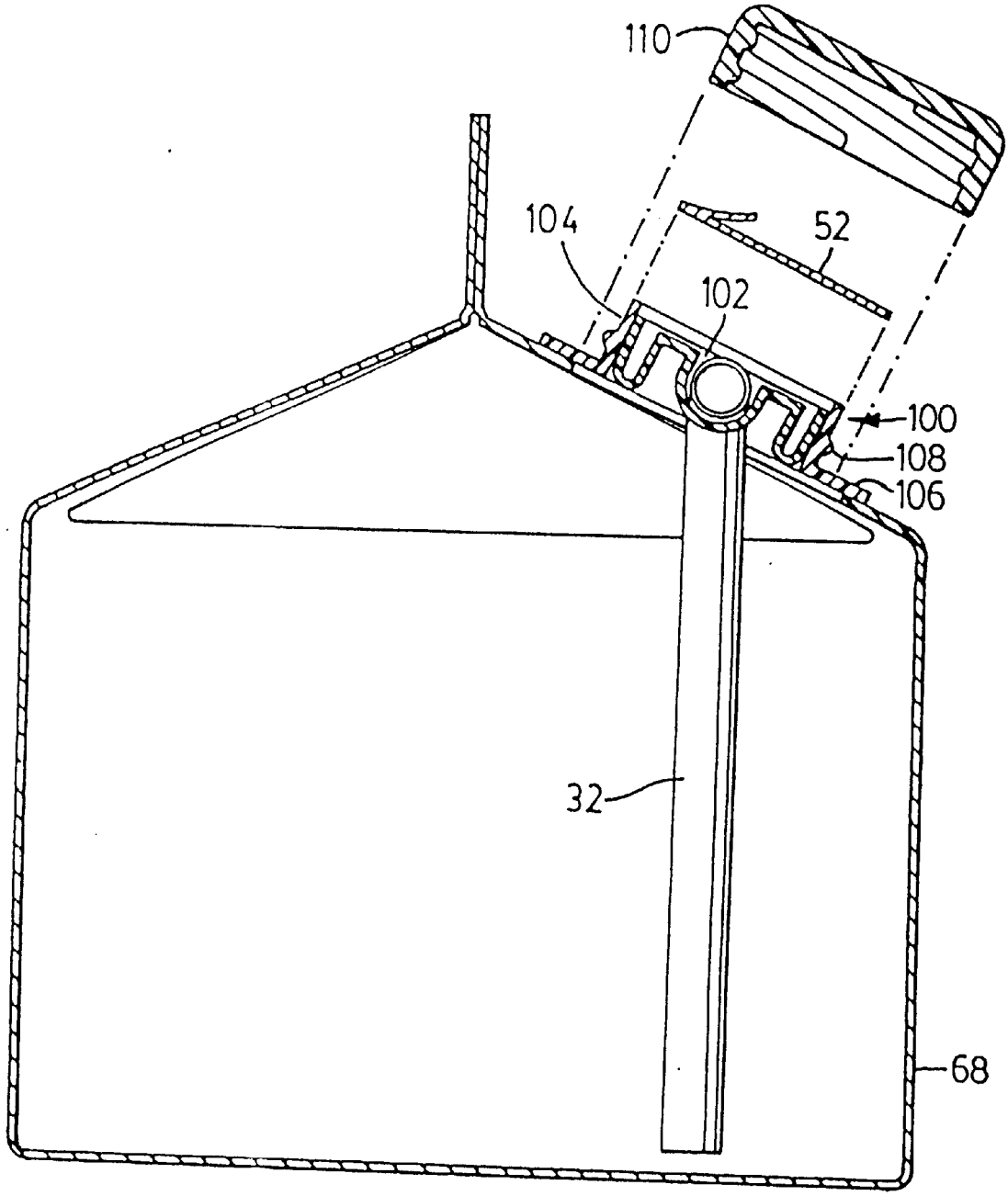
FIG. 20 is a cross sectional view of a holder/straw assembly of the present invention shown in a side spout of a gable type carton beverage container with an expandable bendable straw positioned therein.
Figure 21:
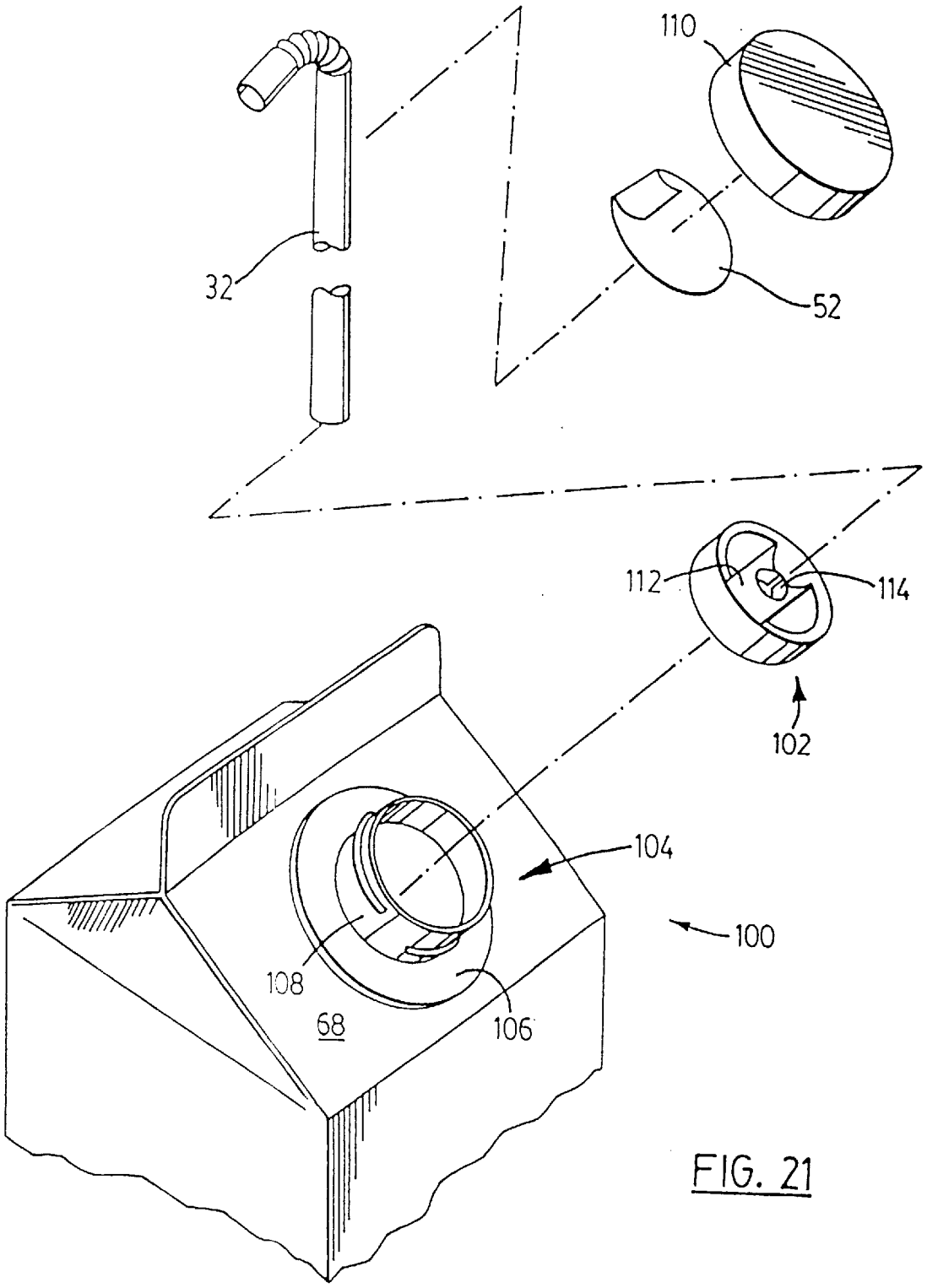
FIG. 21 is an enlarged blown apart broken away perspective view of the holder/straw assembly of FIG. 20.

As an additional embodiment of the holder and strip, a resealable adaptation is illustrated in FIGS. 20 and 21 and shown in a gable top carton 68. Holder assembly 100 shown therein has a removable inner portion 102 and an outer portion 104. The outer portion 104 has a flange 106 which is attached to the carton 68. Outer portion 104 has outer threads 108 which are adapted to engage a cap 110. Inner portion 102, outer portion 104 and cap 110 are generally circular. Inner portion 102 has a trough 112 and an aperture 114 for receiving straw 32. A strip 52 is affixed to inner portion 102 over straw 32.

Referring to FIG. 21, the outer portion 104 is positioned in a gable topped carton 68. The inner portion 102 is positioned in the outer portion 104. Straw 32 is positioned in inner portion 102. Strip 52 is attached to inner portion 102 or outer portion 104. Cap 110 is attached to outer portion 104.

Assembly of the holder assembly 100 including inner portion 102, straw 32 and strip 52 in the outer portion 104 could occur either before or after the outer portion 104 is attached to the carton 68. Inner portion 102 could be positioned in any rotational attitude, either with the trough 112 being horizontal, as in FIGS. 20 and 21 or sloped, with the aperture 114 either proximate to the upper or lower edge of the outer portion 104. The strip 52 as discussed above would be attached so as to provide a liquid and gas tight seal.

Figure 22:
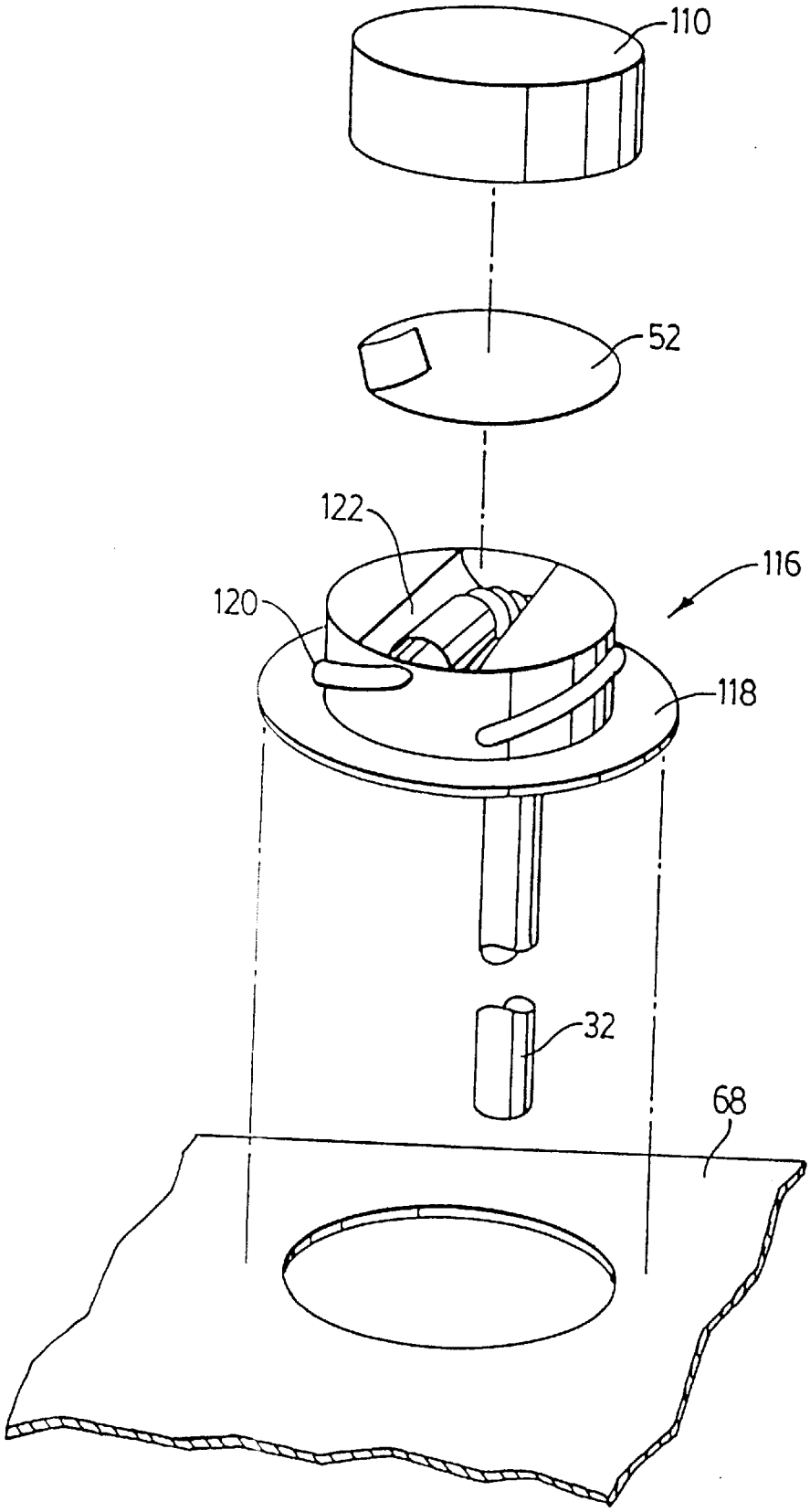
FIG. 22 is an exploded perspective view of an alternative embodiment of the holder/straw assembly of the present invention, shown with a resealable threaded cap and sheet packaging material with a circular cut out hole therein.

Referring to FIG. 22, holder 116 is similar to holder assembly 100 but there is not a separate outer portion and inner portion. Holder 116 has a flange 118, outer threads 120, a trough 122 and an aperture (not shown).

Referring to FIG. 23, as an alternative, the inner portion 124 and straw portion 126 could be integrally attached as shown generally at 128. Similar to the above inner holder 102 described above inner portion 128 would have a press fit into an outer portion 104. The straw portion 126 would be flexible such that if on installation the straw would touch the bottom of the carton the straw would flex so that the inner portion could still fit tightly into the carton. Straw portion 126 has a bevelled end 130 to minimize the chance of the user sucking on the straw such that it sticks to the bottom of the carton and no liquid can enter therein. Straw 32 could be similarly adapted.

Figure 25:
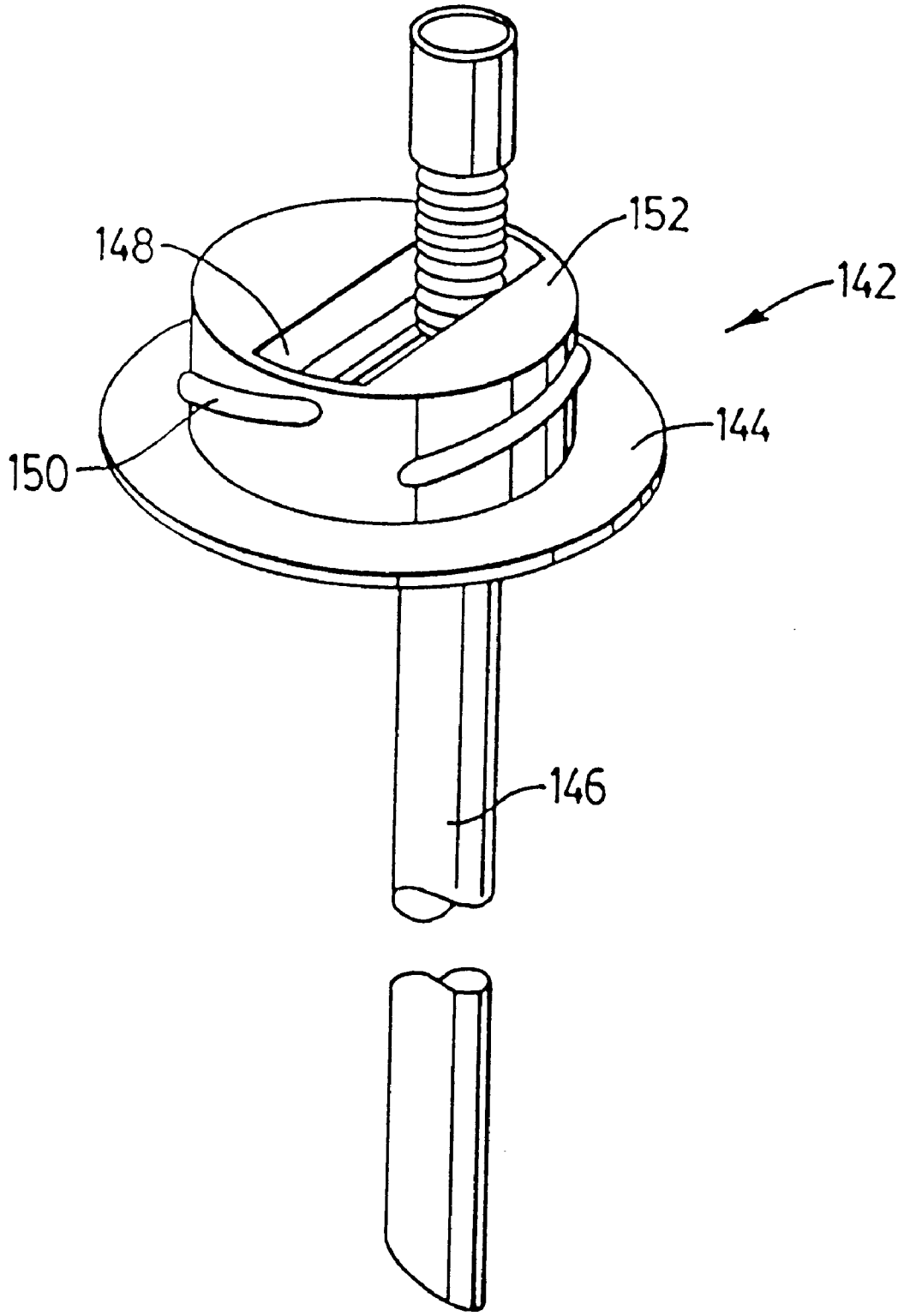
FIG. 25 is a perspective view of an alternate embodiment of the threaded holder of the holder/straw assembly of the present invention, wherein the holder and straw are integrally attached.

Referring to FIG. 25, alternatively the holder portion 152, straw portion 146 and flange 144 are integrally attached to form a unitary resealable straw/holder 142. Unitary resealable straw/holder 142 has outer threads 150 for receiving a cap (not shown) thereon and a trough 148 for receiving the upper portion of straw portion 146 in a stowed position. Unitary resealable straw/holder 142 could accept a strip (not shown) as discussed above.

Figure 26:
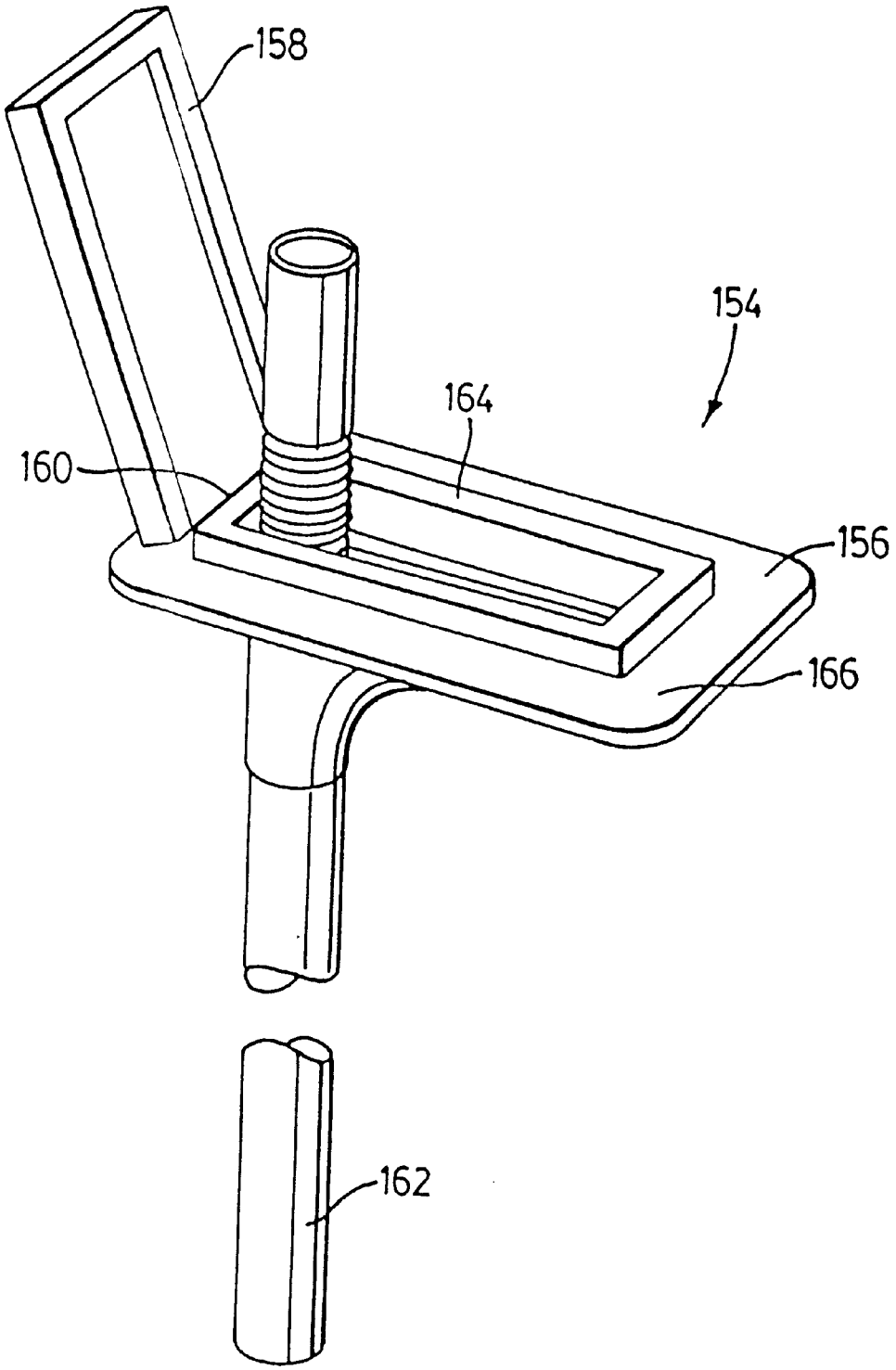
FIG. 26 is a perspective view of an alternate embodiment of the holder/straw assembly shown with a resealable flap.

Referring to FIG. 26, a further alternate holder and straw assembly 154 embodiment is shown wherein a holder 156 is adapted to include a resealable flap 158. A living hinge 160 connects the resealable flap 158 to holder 156. As described above, straw 162 may be separate or integrally attached to the holder. Holder 156 includes a trough 164 for receiving straw 162 in the stowed position and a flange 166.

It will be appreciated by those skilled in the art that liquid container, holder and straw assembly of the present invention have a number of advantages over the prior art. For example since the straw is placed on the inside of the container prior to the container being purchased by a consumer there will be a reduced likelihood of spillage since the user need not pierce the container with the straw. A further advantage is that the straw will not obscure any printed material that is on the outside of the container. A further advantage is that by providing the straw on the inside of the container there is no longer a need for a protective plastic envelope. The liquid container, holder and straw assembly of the present invention provides an aperture formed in the holder and a straw that fits snugly therein, thereby providing access to the liquid only through the straw. This configuration minimizes the likelihood of spillage during use.

Figure 14:
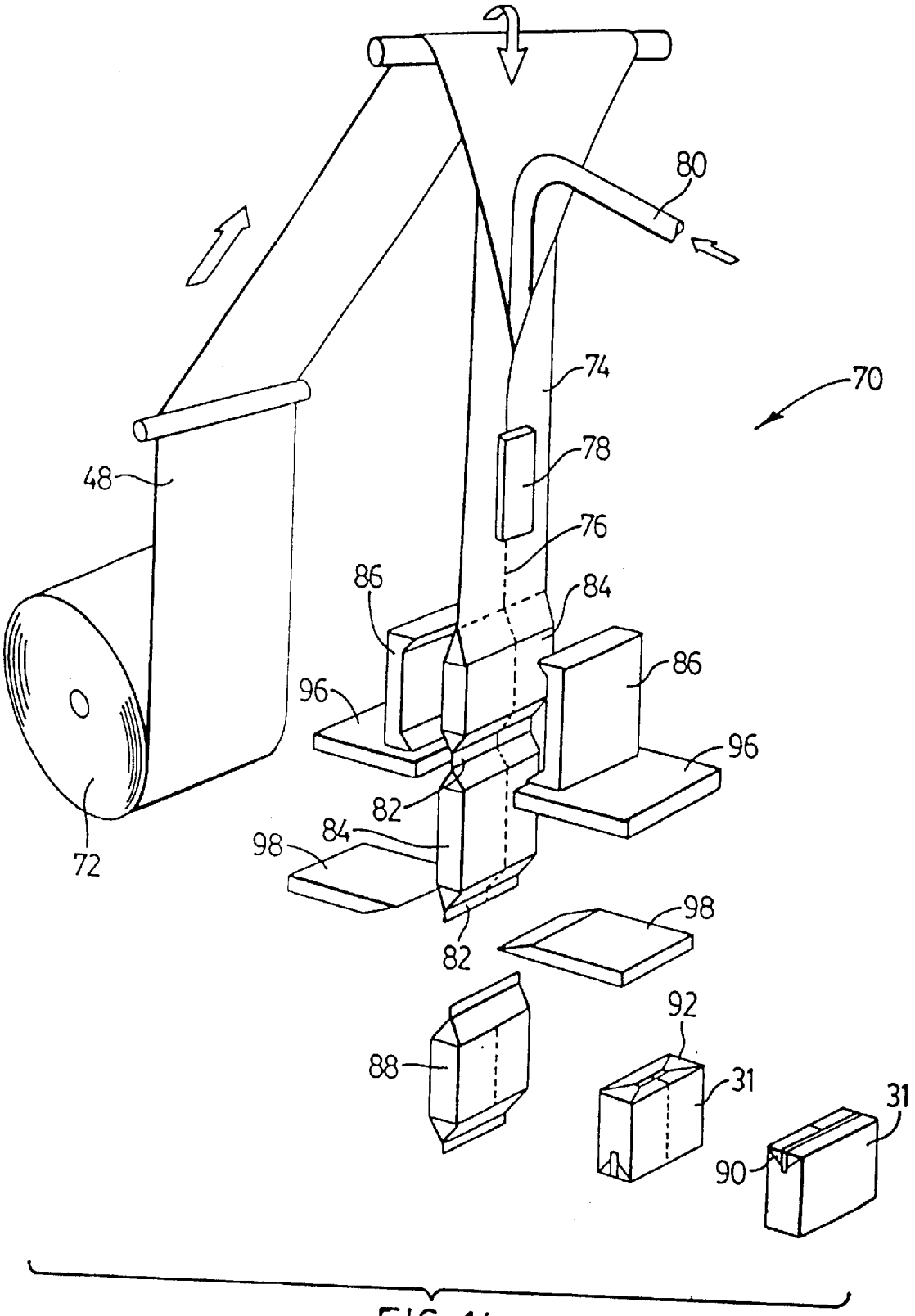
FIG. 14 is a perspective view of the prior art form, fill and seal process for manufacturing a filled carton.

Referring to FIG. 14 the prior art beverage packaging process for the manufacture of parallelepipedic boxes is shown generally at 70. The process is a form, fill and seal type process that employs a reel 72 of printed and creased sheet packaging material 48. Generally the sheet packaging material 48 is of a paper board base laminated on both surfaces with plastic to provide water impermeability. Additional laminations of plastic and aluminum may be used to further improve water and gas impermeability of the sheet material 48.

The sheet packaging material 48 is taken from the reel 72, raised and brought into a vertical orientation where the sheet is wrapped into a continuous columnar sleeve 74 and sealed at a longitudinal seam 76 by a heated sealing device 78. Beverage is added into the columnar sleeve 74 below the sealing device 78 via a pipe 80 that enters the columnar sleeve 74 prior to the formation of the columnar sleeve 74.

At intervals that establish individual cartons of beverage, a transverse seam 82 is formed across the columnar sleeve 74 and through the beverage by sealing jaws 96, The lower portion of the columnar sleeve 74 is roughly formed into an individual carton 84 by forming dies 86 and is then cut from the columnar sleeve 74 by cutting jaws 98. The top and bottom flaps of the cut off cartons 88 are folded, the top flaps 90 are secured to the sides of the carton and the bottom flaps 92 are secured to the bottom of the carton to form the finished carton 31 as described above. It will be appreciated by those skilled in the art that only the basic steps of the form, fill and seal process are shown. For example other pairs of forming dies are required to transform the cut off carton 88 as cut from the columnar sleeve 74, from its cushion shape to the parallelepipedic carton 31 shape.

Referring to FIGS. 15–19, the above described process has been adapted to include the application of assembly 56. Tooling (not shown) bears on the flange 46 of the holder 34 during the application of the assembly 56 to the lining 62 of the boxboard material 48 at the perimeter of the oblong hole 60. As it is required that the sheet material 48 be wrapped from a flat sheet into the columnar sleeve 74 it will also be required that the assemblies 56 attached to the material 48 be temporarily moved to keep the extended straws 32 from interfering with the forming and sealing of the columnar sleeve 74.

Figure 16:
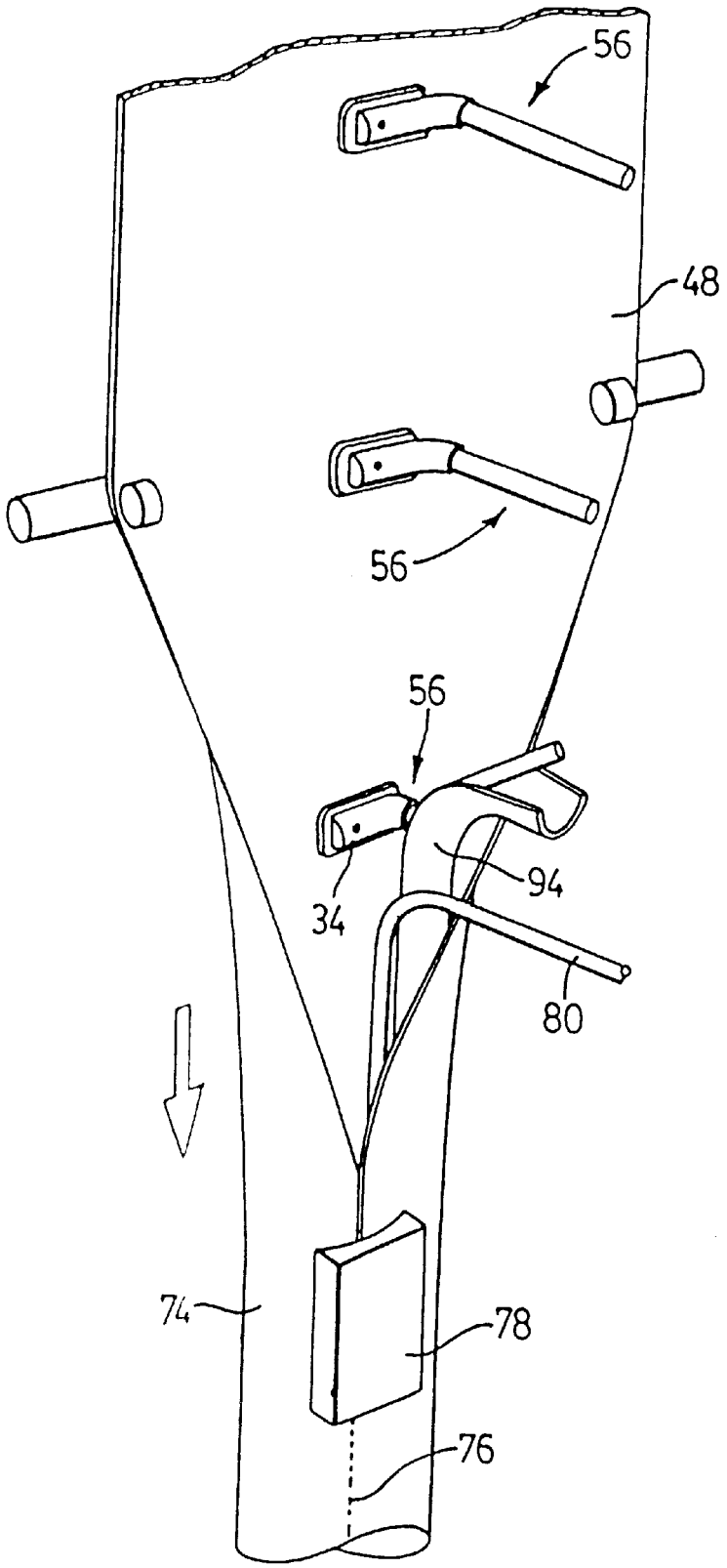
FIG. 16 is an enlarged perspective view of that portion of the form, fill and seal process of the present invention wherein. the assembly is attached and the straw is moved so as not to interfere with the continuous sheet being formed and sealed into a column.
Figure 17:
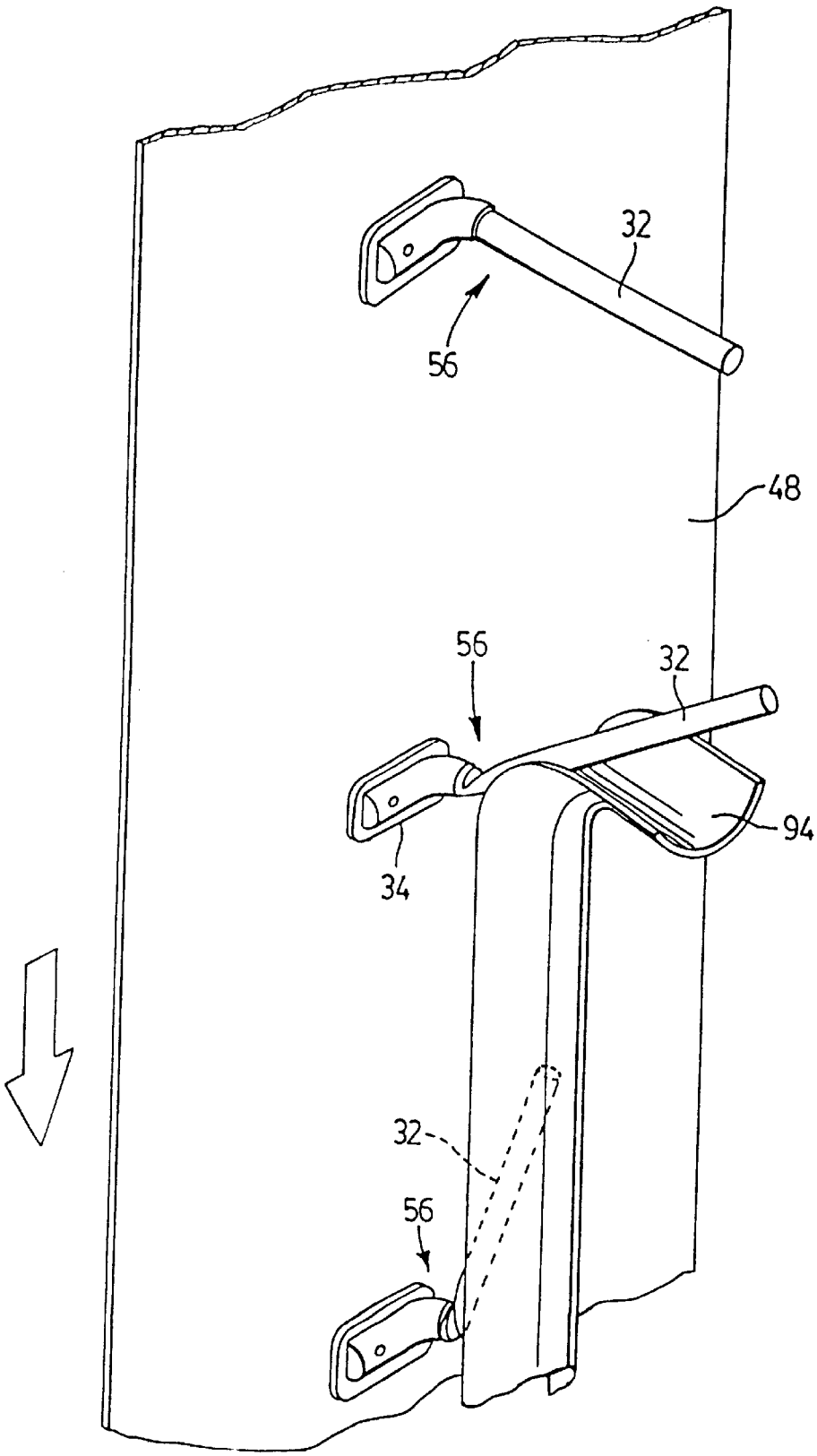
FIG. 17 is an enlarged perspective view of the continuous sheet with assemblies attached thereto and a straw shown engaging a guide.
Figure 18:
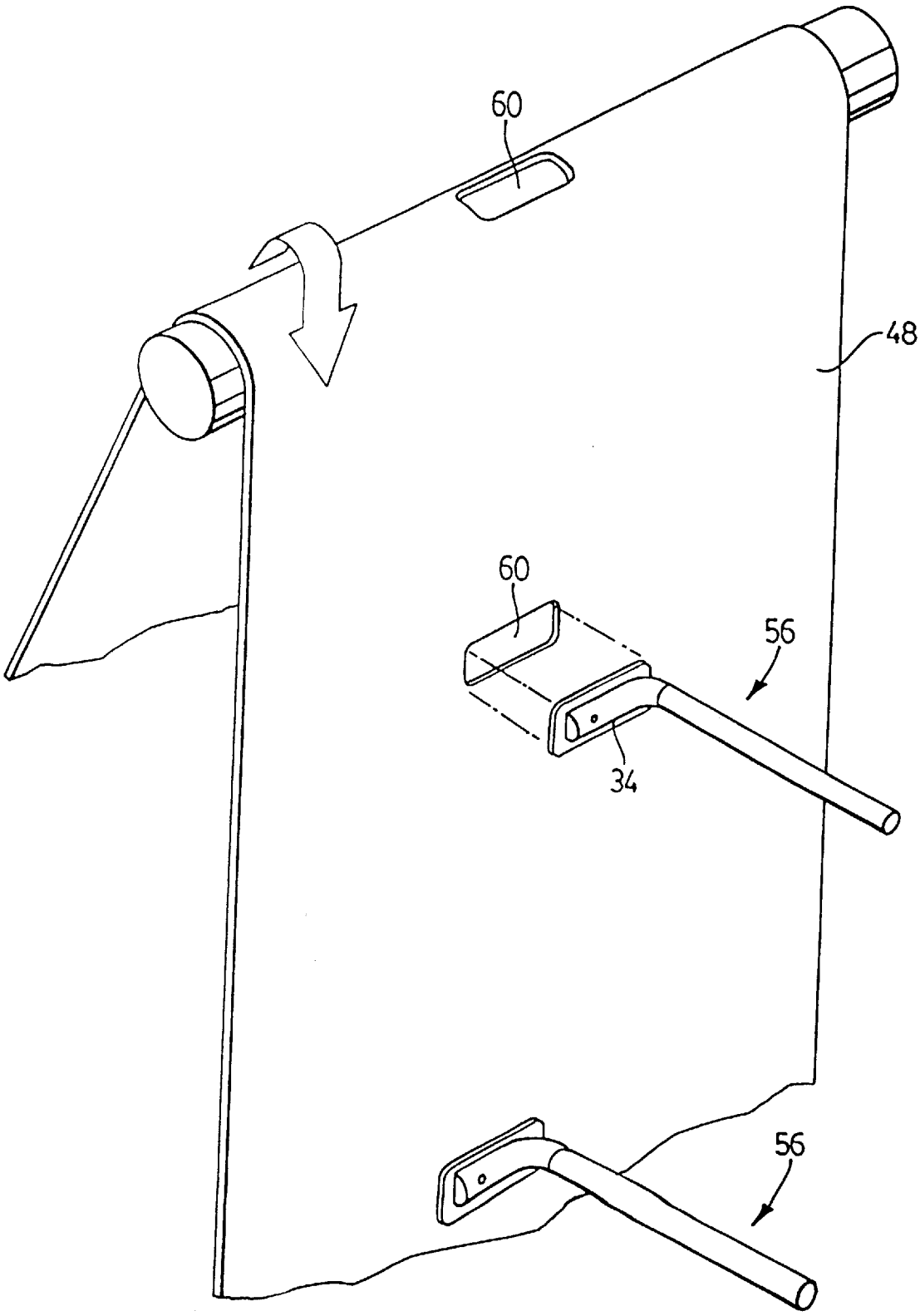
FIG. 18 is an enlarged perspective view showing attachment of the assembly to a continuous sheet material.
Figure 19:
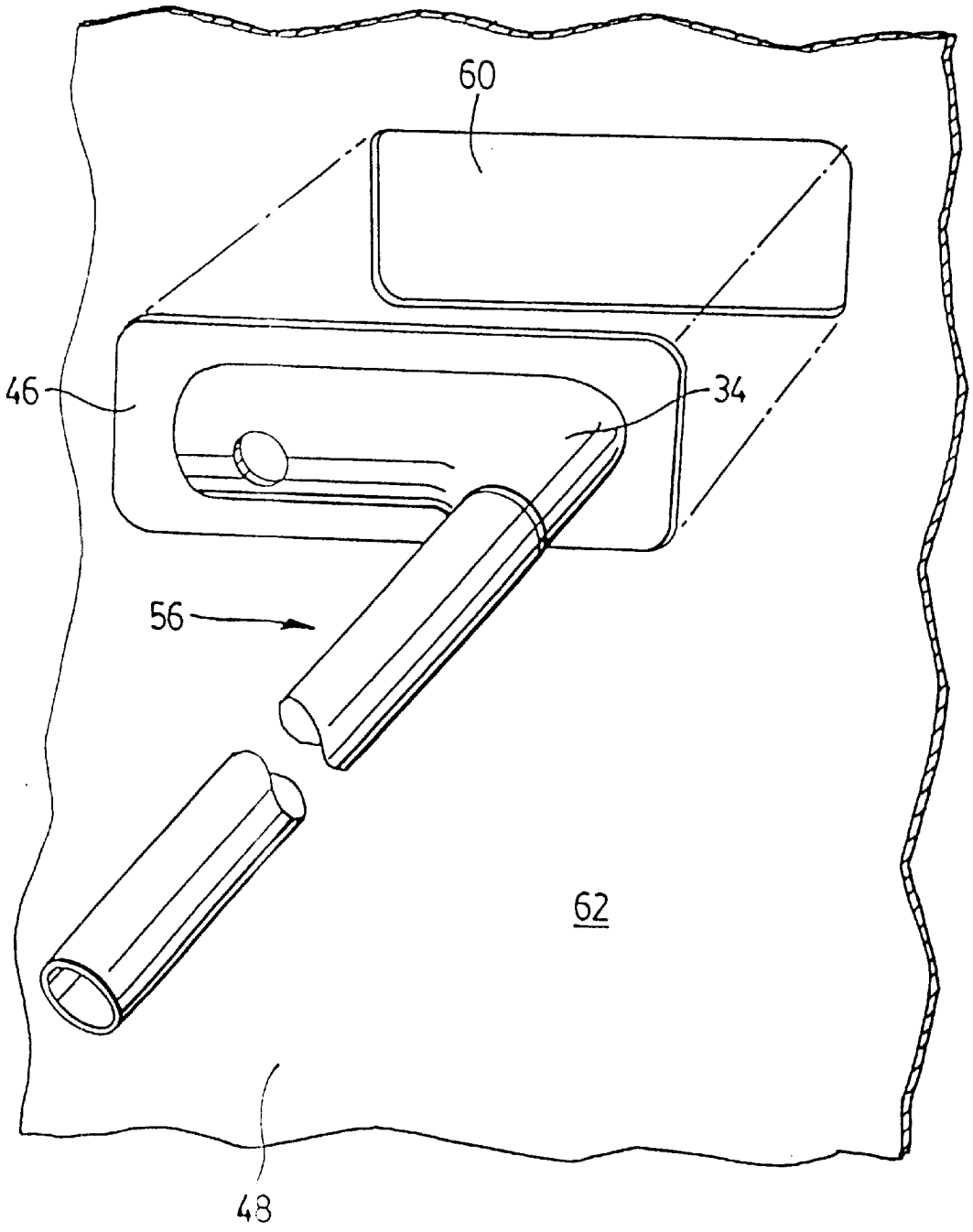
FIG. 19 is an enlarged perspective view showing attachment of the assembly to the sheet material of the carton.

A guide 94 which is generally an elongate "L"-shaped guide and which is generally "U"-shaped in cross section is illustrated in FIGS. 16 and 17 to temporarily move the straws 32 and to keep each clear of the wrapping and sealing process. The guide 94 will extend into the columnar sleeve 74 along with the beverage pipe 80. The longitudinal seam 76 and heated sealing device 78 are shown in FIG. 16 as well.

Figure 15:
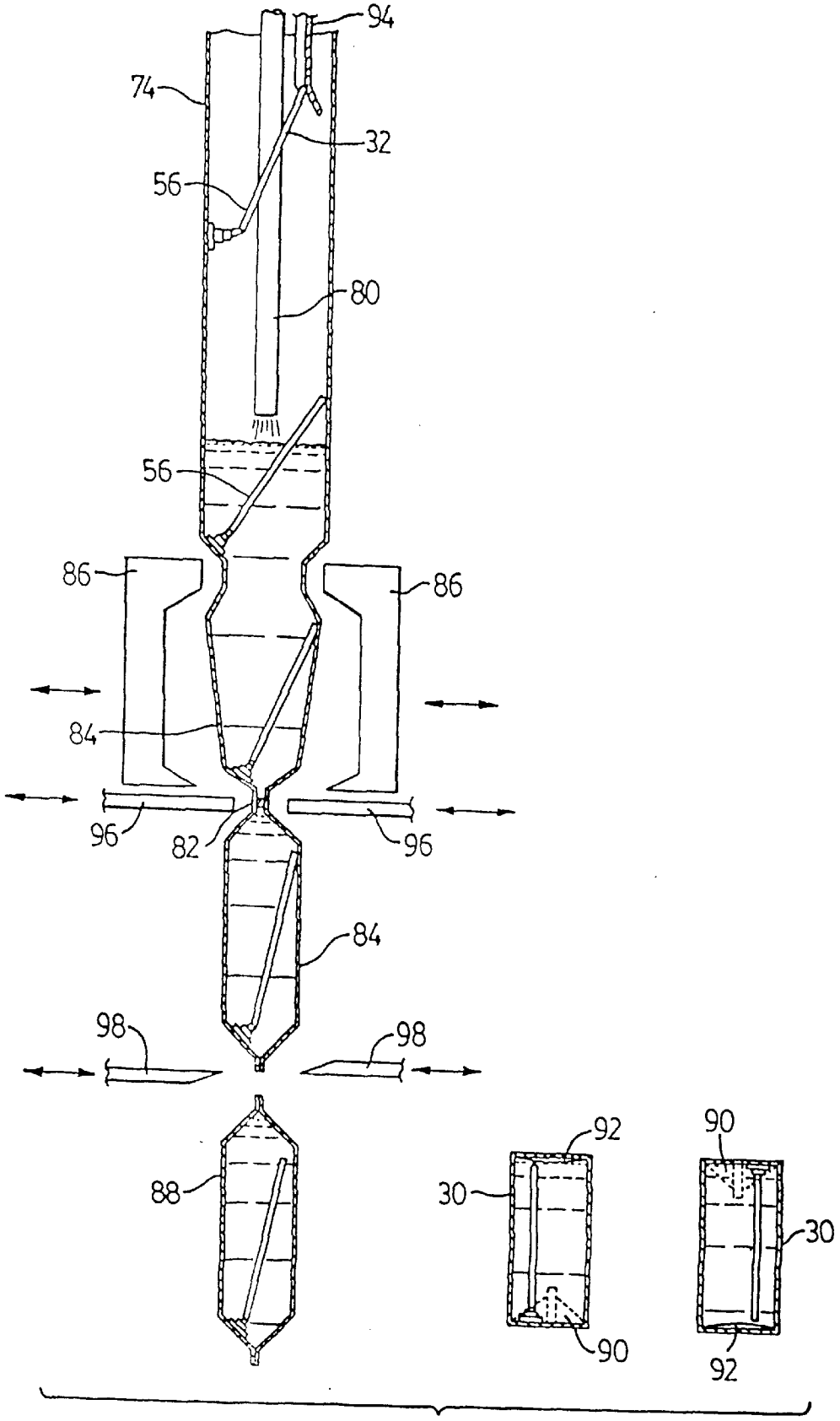
FIG. 15 is a sectional view of a portion of the form, fill and seal process, of the present invention, thereby manufacturing a filled carton with a straw therein.

At a point below the formation of the longitudinal seam 76 the guide 94 is terminated and the straw 32 is allowed to lean against the opposite wall of the columnar sleeve 74 as illustrated in FIG. 15. As seen in FIGS. 15, 16 and 17, a holder 34 of this thin wall design would allow both some degree of strain relief to the moved straw 32 during formation of the columnar sleeve 74 and some freedom for the consumer to redirect the drinking straw 32 to get the last drop of beverage from the carton 30 or 68.

As the columnar sleeve 74 is progressively advanced downwardly, beverage is supplied to the inside of the columnar sleeve 74 via beverage pipe 80, forming dies 86 roughly form the individual cartons 84, sealing jaws 96 form a transverse seal 82 across the columnar sleeve 74 and through the beverage and cutting jaws 98 cut the sealed individual carton 84 from the columnar sleeve 74.

The top flaps 90 and bottom flaps 92 resulting from the forming and cutting steps are folded and attached to the sides and bottom respectively of the beverage carton, to produce the finished beverage carton 30, also shown in FIG. 1.

The finished beverage carton 30 is illustrated in FIGS. 1, 8 and 9, with a partially removed side panel to better illustrate the orientation of the straw 32 inside the carton 30.

It will be appreciated by those skilled in the art that there are a number of variations in the steps that may be used to attach the assembly 56 to the sheet packaging material 48. For example the assembly 56 may be attached to the outside of the sheet packaging material 48 (that is the outside of the carton when it is formed) rather than the inside the seal 52 may be attached separately or at the same time as the rest of the assembly 56; the hole 60 may be cut at the same time as the assembly 56 is attached, just prior to attaching the assembly 56 or prior to the sheet packaging material 48 being wound onto reel 72. Similarly the attachment of the assembly 56 can also be adapted to a sleeve form, fill and seal process and similar variations thereof can also be contemplated.

Some of variations in the details of the step of attaching the assembly 56 in the continuous form, fill and seal process will now be discussed with reference to FIGS. 27–36. Further thereafter, some of the variations of the sleeve form, fill and sleeve process will be discussed with reference to FIGS. 37–40.

Figure 27:
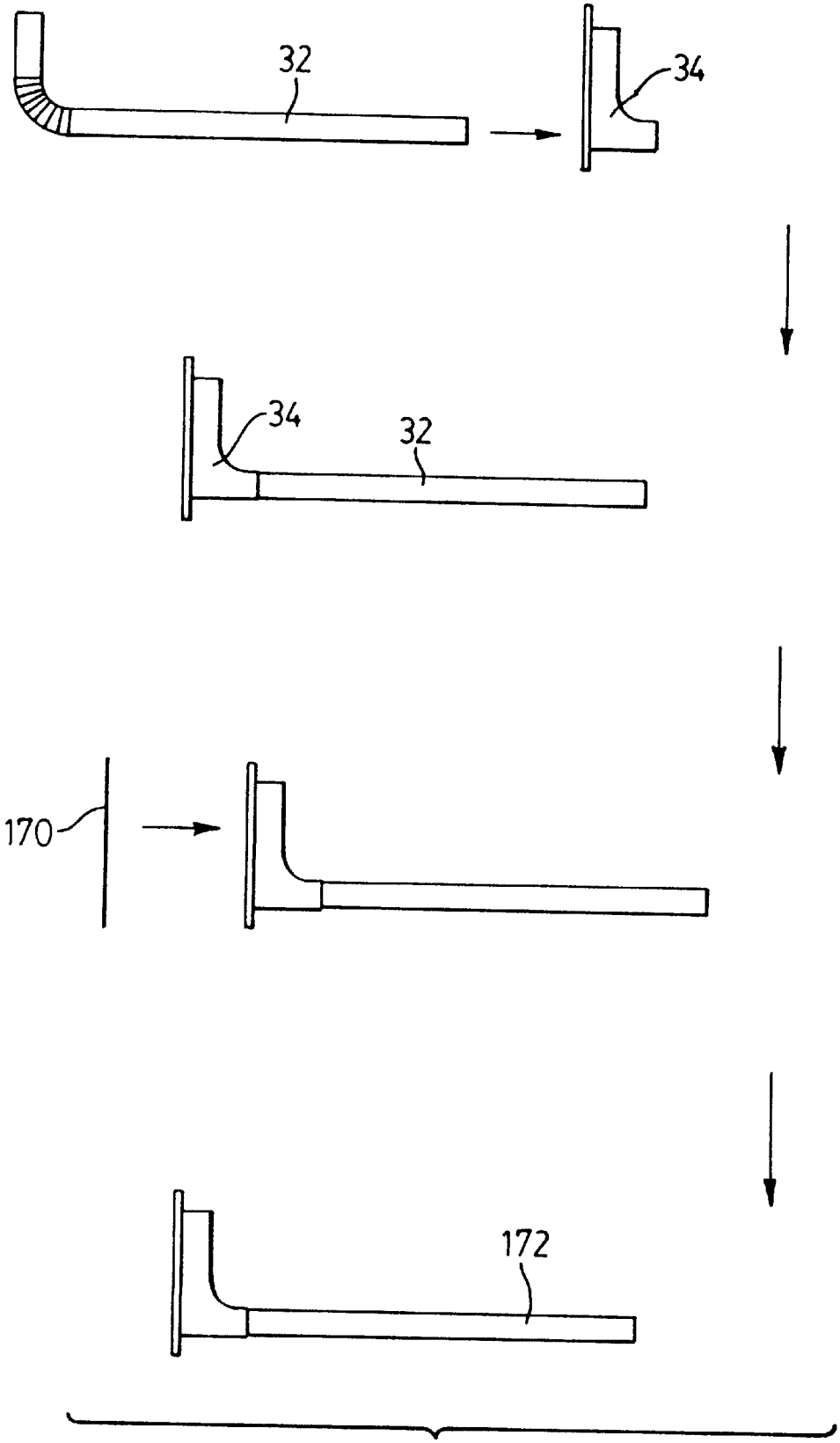
FIG. 27 is a sequential side view of steps in the assembly of a straw, seal and holder assembly of the present invention.
Figure 28:
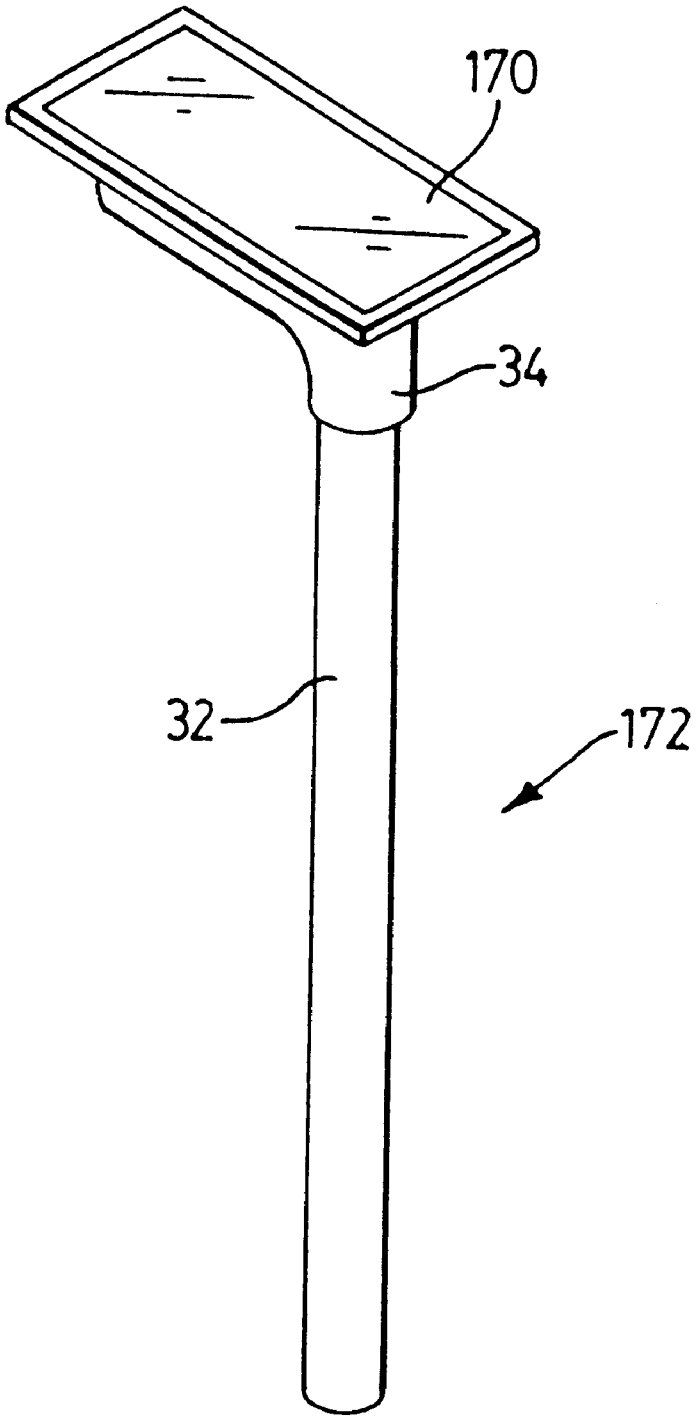
FIG. 28 is a perspective view of the straw, seal and holder assembly of FIG. 27.

As shown in FIG. 27, the straw 32 is inserted into the holder 34 and sealed inside the holder 34 in the stowed form by holder seal 170 the completed assembly being shown at 172. FIG. 28 shows the completed assembly 172 with holder seal 170 keeping the straw 32 in the stowed position.

Figure 29:
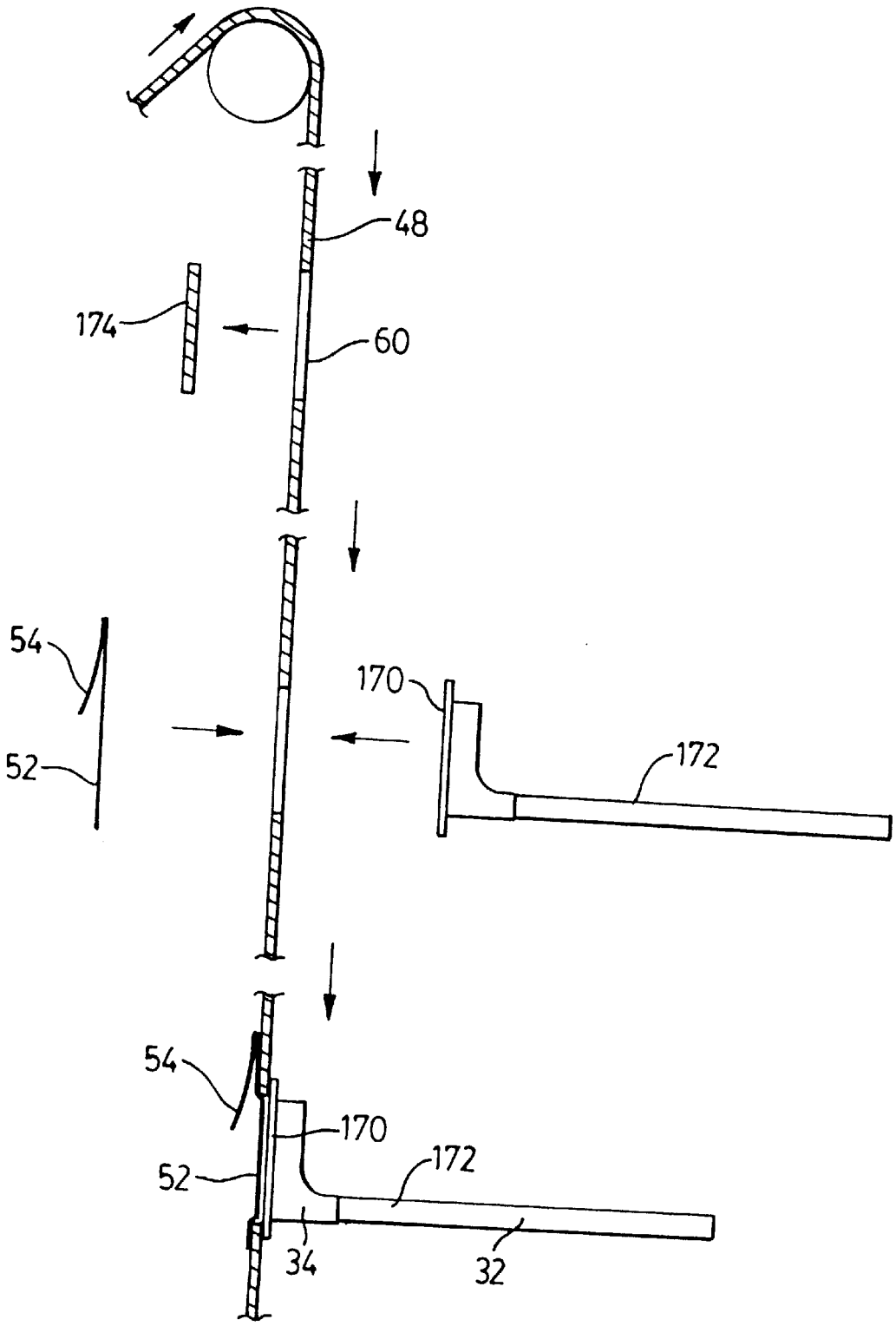
FIG. 29 is sectional view of a portion of the form, fill and seal process of the present invention, showing the attachment of the assembly of FIG. 28.

An application of assembly 172 to the form, fill and seal process of manufacturing a filled beverage carton is shown in section in FIG. 29 where a hole 60 is cut in the sheet packaging material 48 and the waste or cut out portion 174 is removed. Assembly 172 with holder seal 170 is applied to the inside of the sheet packaging material 48 and seal 52, with tab 54, is applied to the outside of the sheet packaging material 48. As shown in this embodiment, assembly 172 may be applied at the same time as seal 52 is applied. Preferably seal 52 is attached to holder seal 170 such that removal of seal 52 by pulling on tab 54 will cause holder seal 170 to be removed thus allowing the straw 32 to be accessed from the outside of the sheet packaging material 48 or the outside of beverage container 30.

Figure 30:
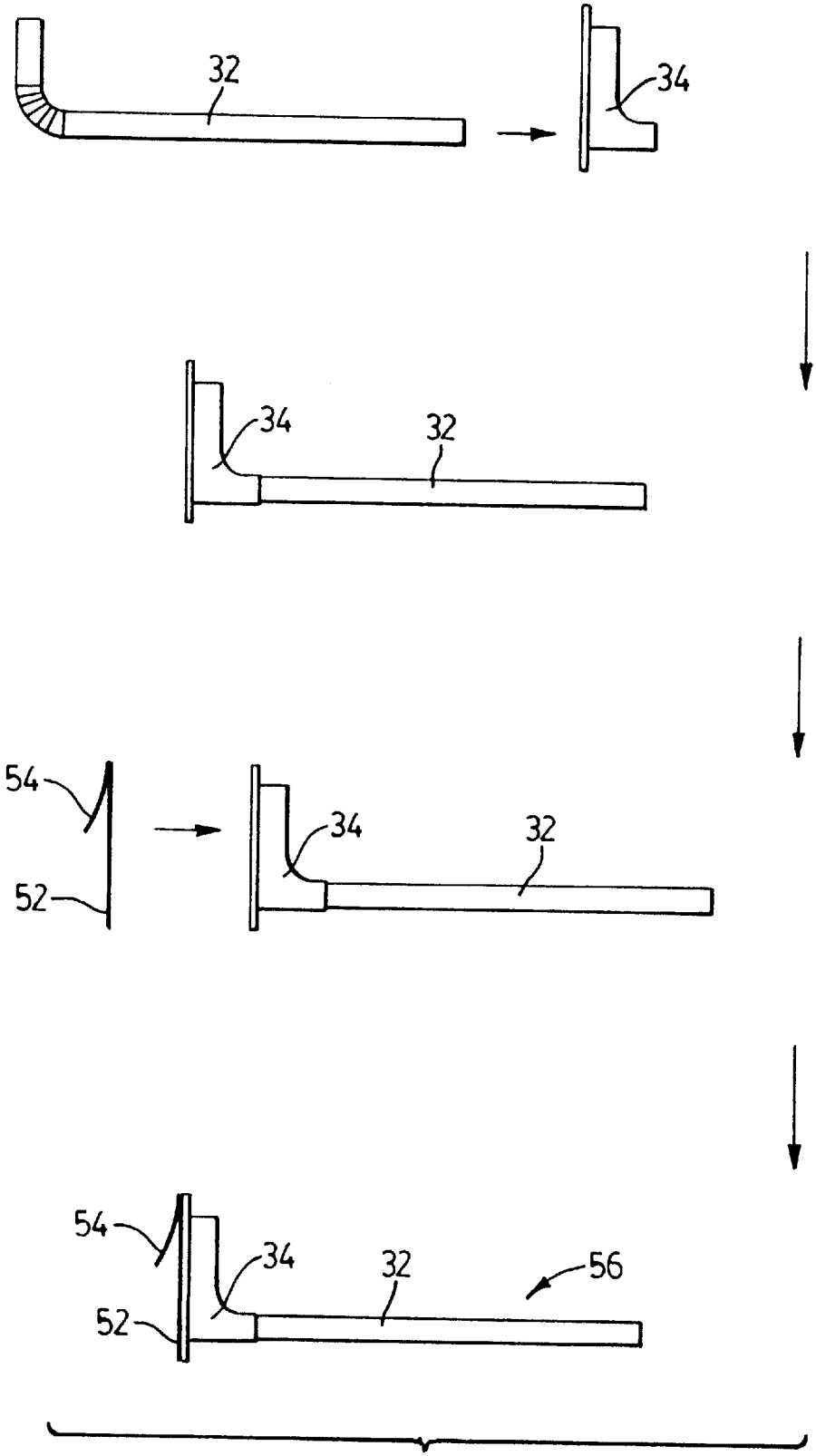
FIG. 30 is a sequential side view of the steps in the assembly of an alternate straw, seal and holder assembly of the present invention.
Figure 31:
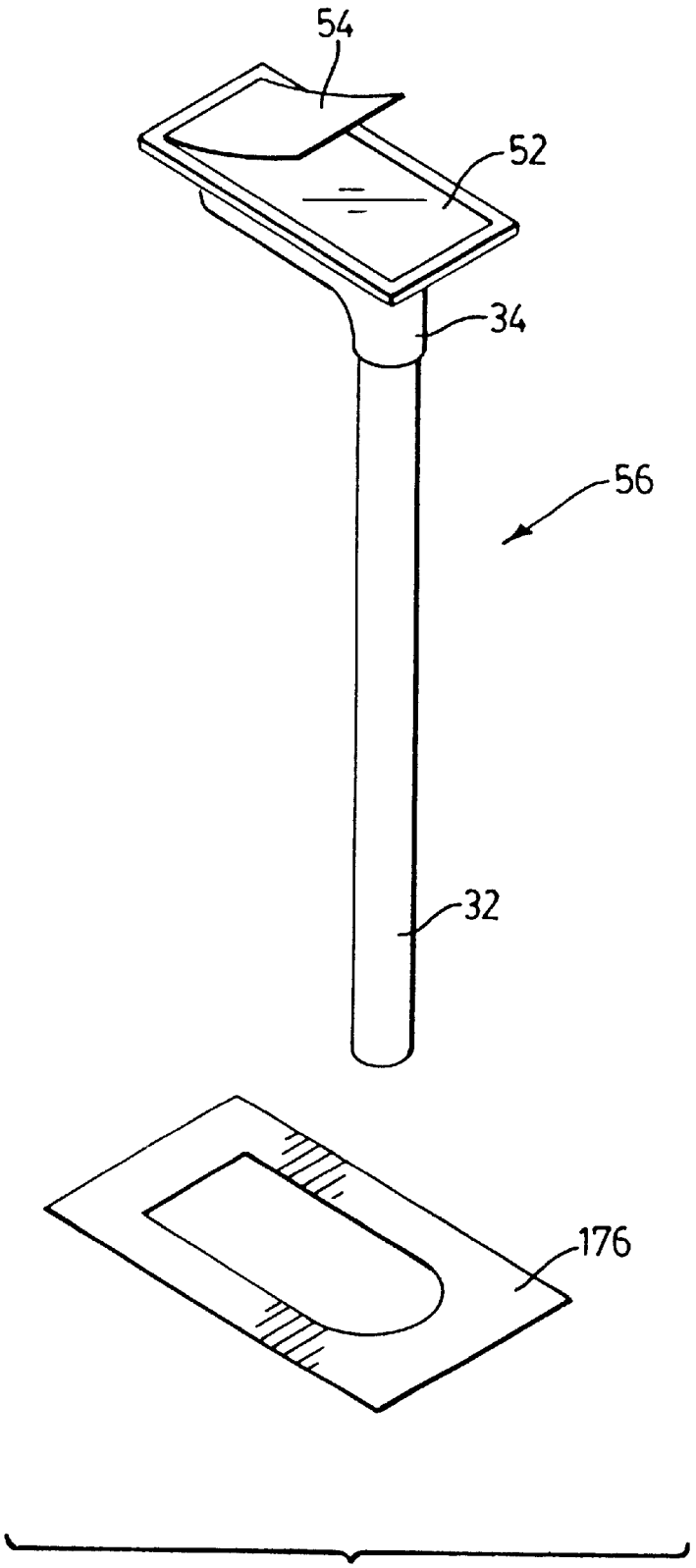
FIG. 31 is a perspective view of the alternate straw, seal and holder assembly of FIG. 30, shown with a separate inner seal.

As an alternative to the assembly process shown in FIG. 27, a process is shown in FIG. 30 wherein the straw 32 is inserted into the holder 34 and sealed inside the holder 34 in the stowed condition by seal 52 directly. The completed assembly being shown at 56, where seal 52 has a tab 54. FIG. 31 shows the completed assembly 56 with seal 52 keeping the straw 32 in the stowed position. Also shown in FIG. 31, is an inner seal 176. The purpose of inner seal 176 is to provide a sealing means for the paper board that is exposed when a hole is cut through the sheet packaging material 48.

Figure 32:
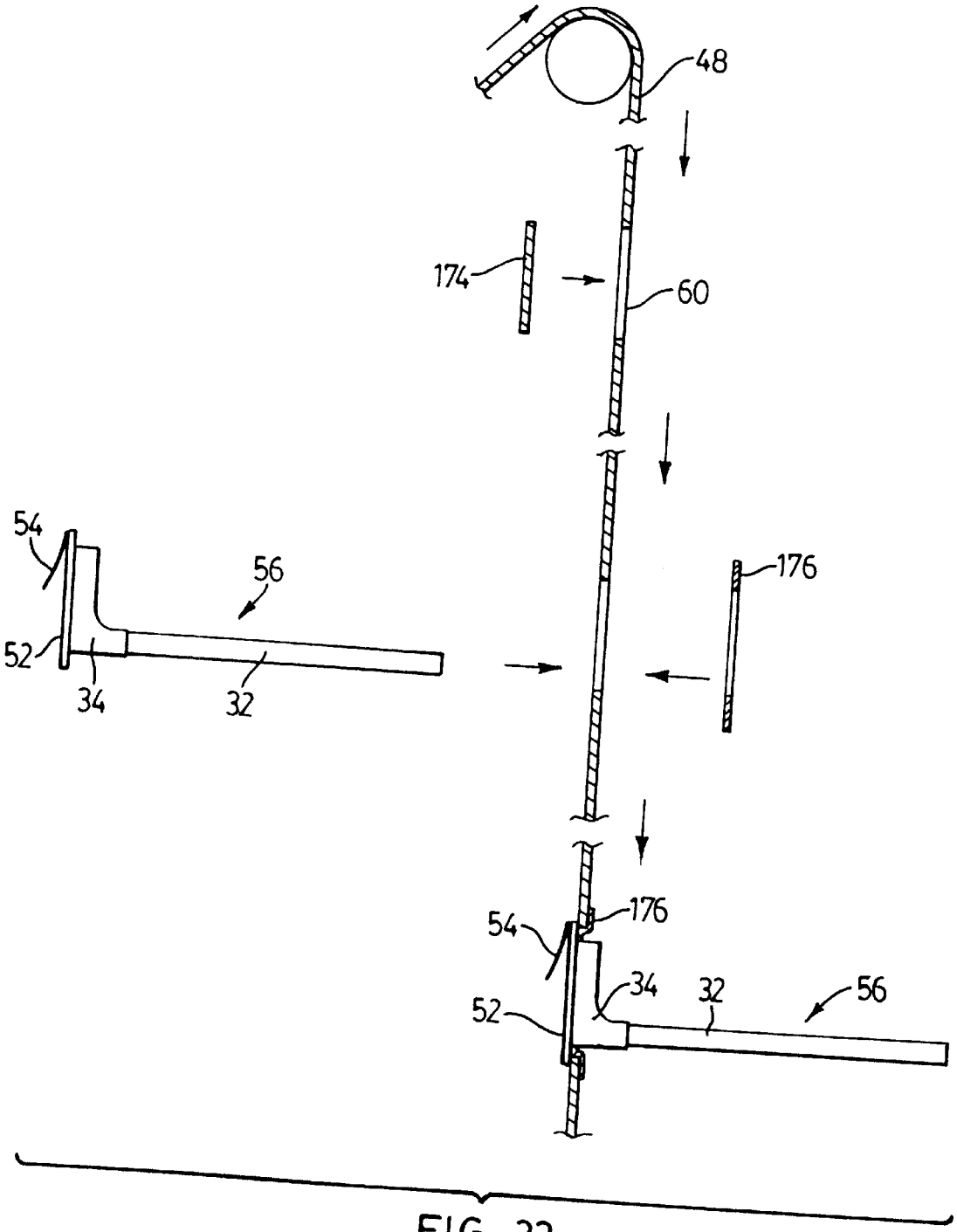
FIG. 32 is sectional view of a portion of the form, fill and seal process of the present invention, showing the attachment of the alternate assembly and seal of FIG. 31.

An application of assembly 56 to the form, fill and seal process of manufacturing a filled beverage carton is shown in section in FIG. 32 where an opening 60 is cut in the sheet packaging material 48 and the waste portion 174 is removed. Assembly 56 with seal 52 is applied to the outside of the sheet packaging material 48 while inner seal 176, is applied to the inside of the sheet packaging material 48. Assembly 56 and inner seal 176 are attached such that a liquid and gas tight seal is established between the inside and outside of the sheet packaging material 48 and inner seal 176 is applied to both the inner surfaces of the sheet packaging material 48 and the holder 34. Once the form, fill and seal process has been completed removal of seal 52, by pulling on tab 54, allows the straw 32 to be accessed from the outside of the sheet packaging material 48.

Figure 33:
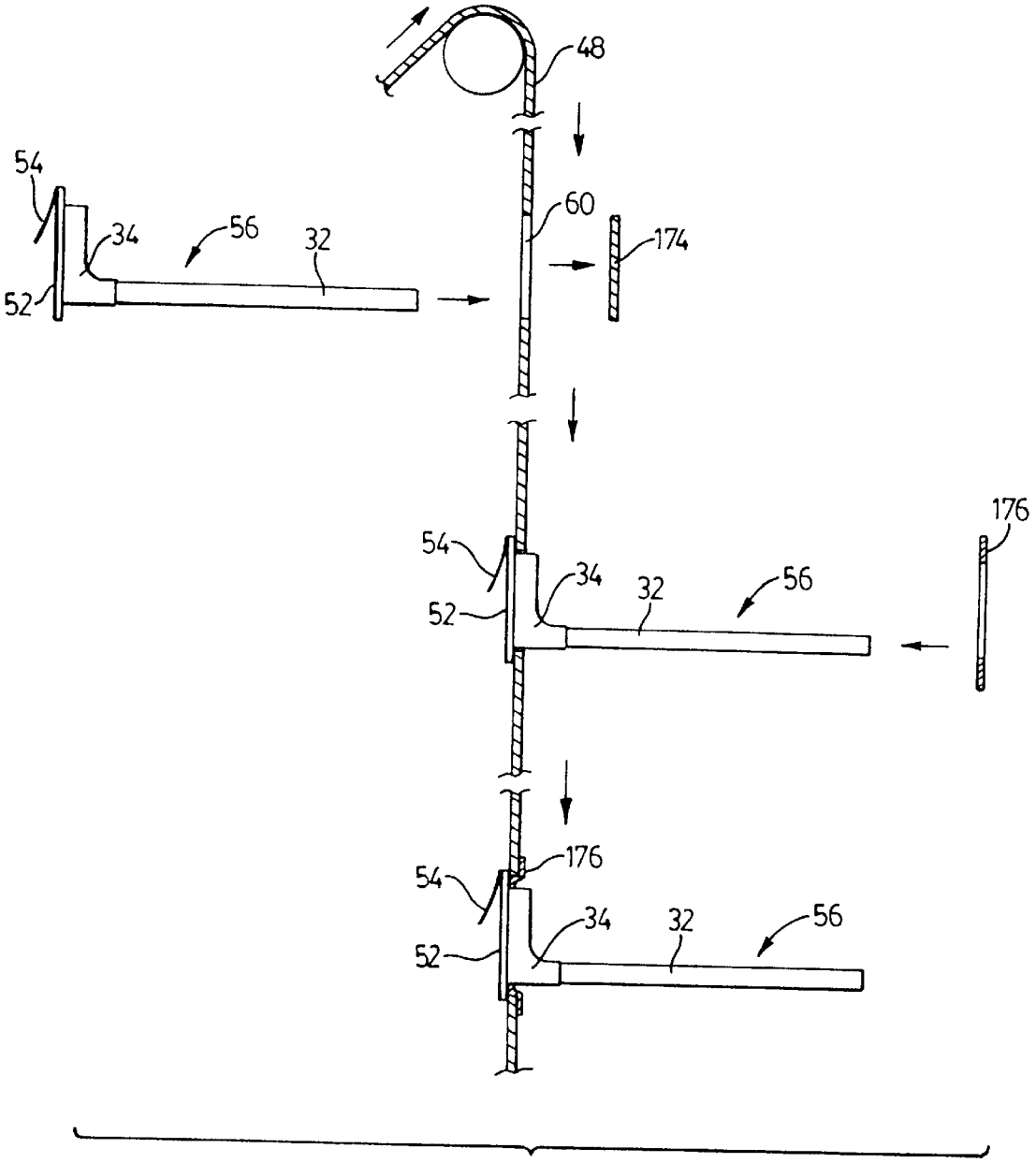
FIG. 33 is sectional view of a portion of the form, fill and seal process of the present invention, showing an alternative attachment of the assembly and seal of FIG. 31, where the creation of an opening coincides with the attachment of the assembly.

A variation to the assembly attaching process shown in FIG. 32, is shown in FIG. 33. In this embodiment, the attachment of assembly 56 occurs in the same step with the cutting of the hole 60 and the removal of the waste 174. It is suggested that where the attaching and cutting actions occur in the same step, a close tolerance between the location of the cut out hole 60 and the location of the attached assembly 56 can be achieved. Alternatively, as shown in FIGS. 32 and 29 where the cutting out of the holes and the attachment of the assemblies occurs as consecutive steps, there would be greater effort required to maintain the same degree of close tolerance on the location of the holes and the point of attachment of the assemblies. Further during the process in FIG. 33, inner seal 176 would be applied to the inside of the sheet packaging material 48 at a later step, where the application of inner seal 176 would serve, as it did in FIG. 32, to seal the exposed paper board edge that is formed when the hole 60 is cut in the sheet packaging material 48. As in FIG. 32, once the form, fill and seal process has been completed removal of seal 52, by pulling on tab 54, allows the straw 32 to be accessed from the outside of the sheet packaging material 48.

Figure 34:
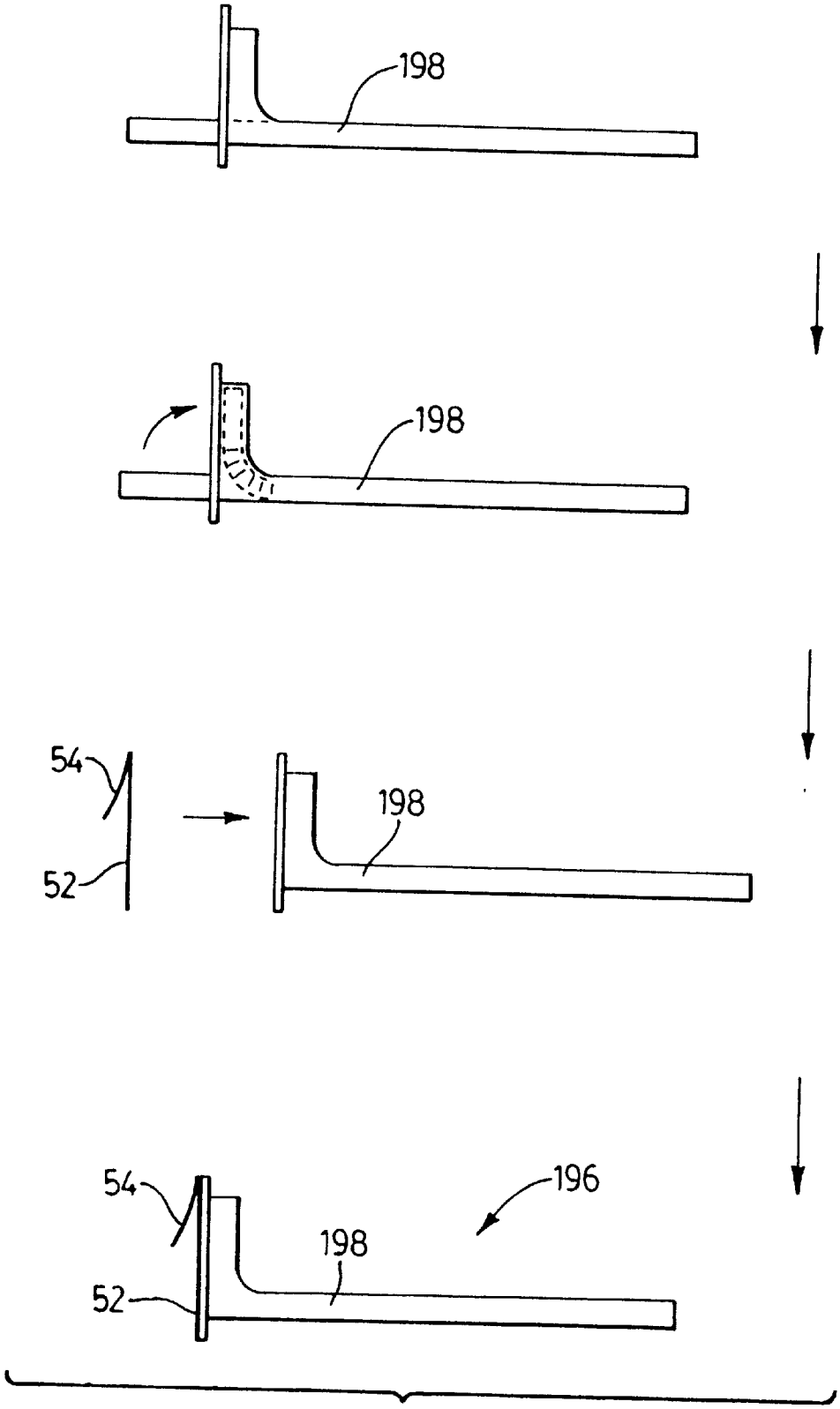
FIG. 34 is a sequential side view of steps in the assembly of a holder/straw and seal assembly of the present invention.
Figure 35:
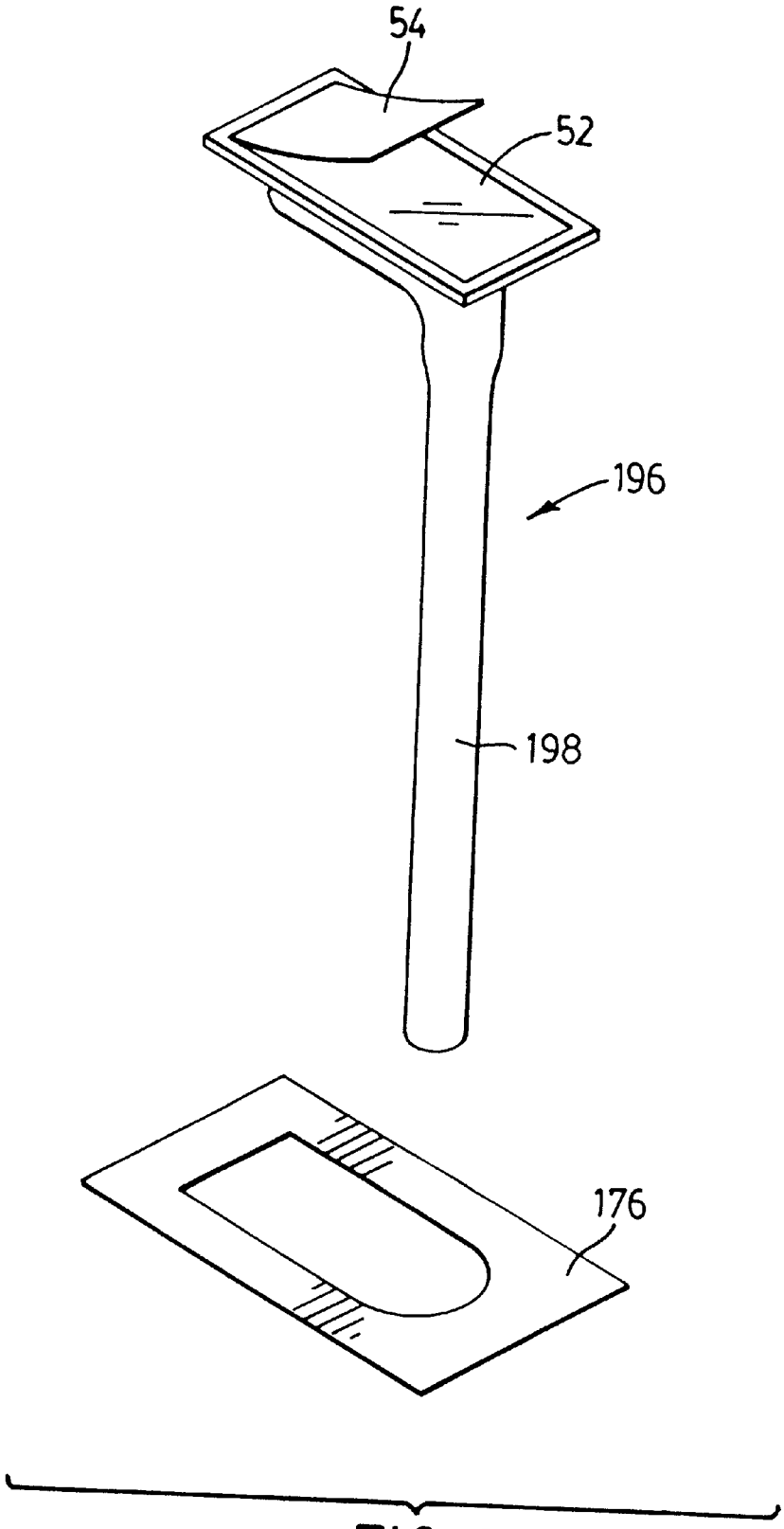
FIG. 35 is a perspective view of the holder/straw and seal assembly of FIG. 34.
Figure 36:
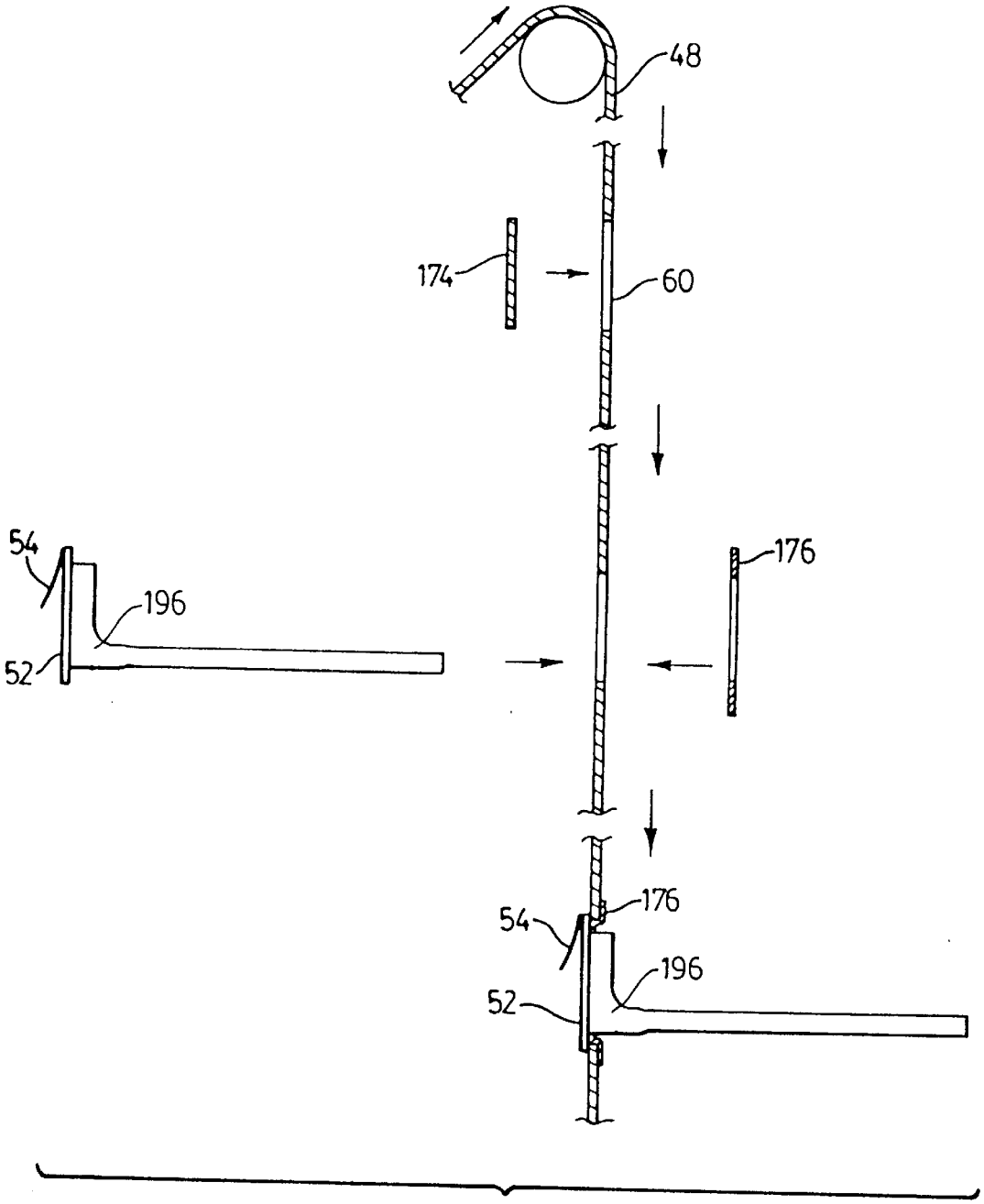
FIG. 36 is sectional view of a portion of the form, fill and seal process of the present invention, showing the attachment of the assembly of FIG. 35.

Another variation is shown in FIGS. 34, 35 and 36 wherein the assembly 196 includes a unitary holder and straw 198 (as best seen in FIG. 35). The process for attaching assembly 196 to the sheet packaging material 48 is similar to those described above and one variation thereof is shown in FIG. 36. That embodiment is similar to the process shown in FIG. 32.

Figure 37:
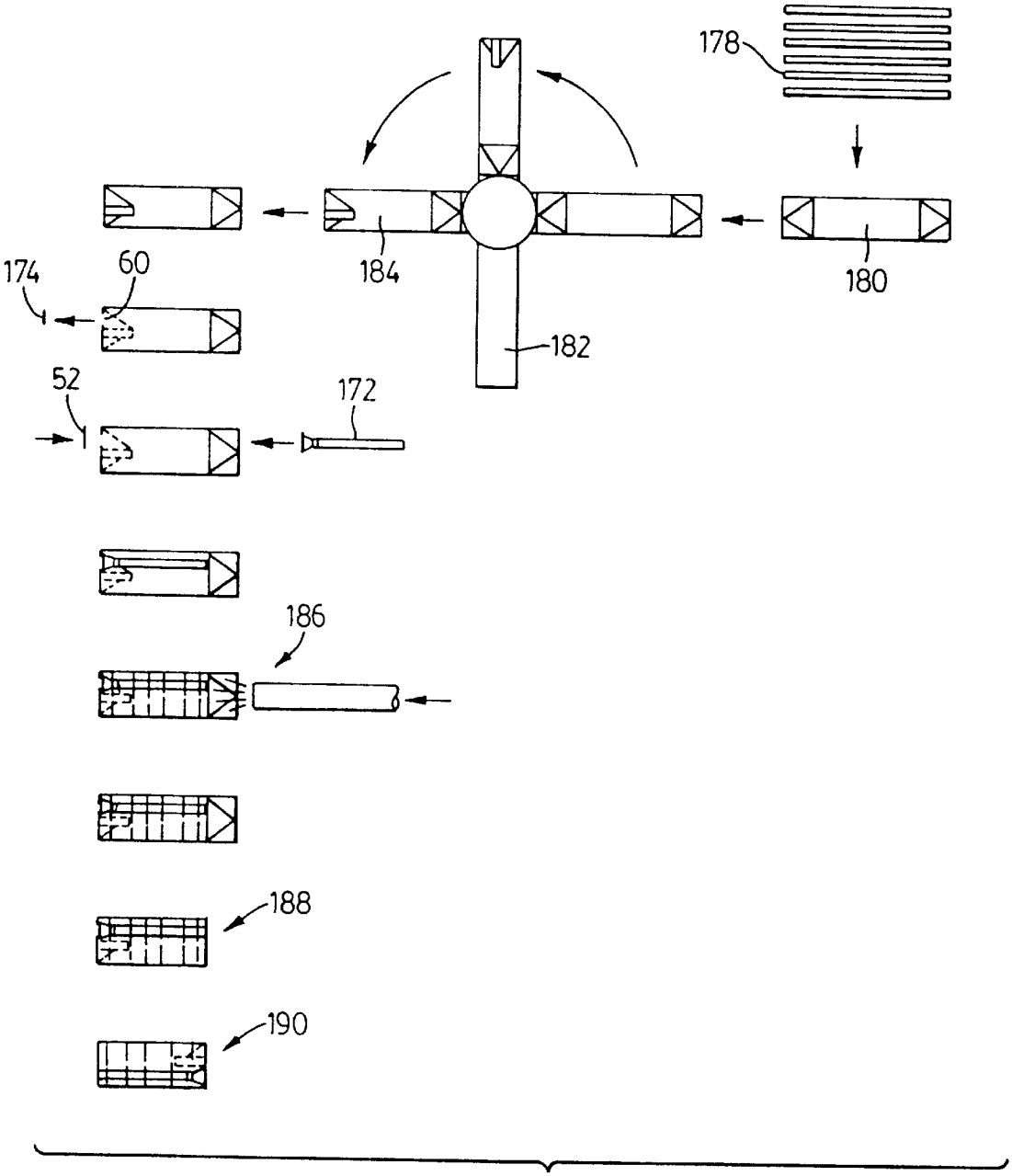
FIG. 37 is a partial sectional view of a sleeve form, fill and seal process of the present invention, showing the attachment of the assembly of FIG. 28 after a hole has been created in the top of the carton.

As discussed, the application of assembly 172 and seal 52 can be applied to the production of a filled beverage carton by means of the sleeve form, fill and seal process shown in FIG. 37. During this process a carton sleeve that has a longitudinal seal already formed and that is folded into a flattened parallelogram shape 178, is taken and raised into a sleeve form 180, slid onto a mandrel 182, has its top end closed, sealed and resulting tabs folded and secured to the sides of the carton 184. The carton then has a hole 60 cut in the top of the carton and the waste portion 174 is then removed. Assembly 172 and seal 52 are then attached on either side of hole 60. Assembly 172 may be applied to the inside of the carton and seal 52 may be applied to the outside of the carton as best seen in FIG. 37. As with the form, fill and seal process shown in FIG. 29, the holder seal 170 of assembly 172 and the seal 52 would be attached together in a manner that, upon pulling tab 54 of seal 52, causes seal 52 to be removed and similarly cause holder seal 170 which is attached thereto to be removed. After assembly 172 and seal 52 have been attached the carton is then filled with the beverage 186 after which the bottom of the carton is closed, sealed and the resulting tabs are secured to the bottom of the carton 188. Finally the carton 190 is inverted into the upright position.

Figure 38:
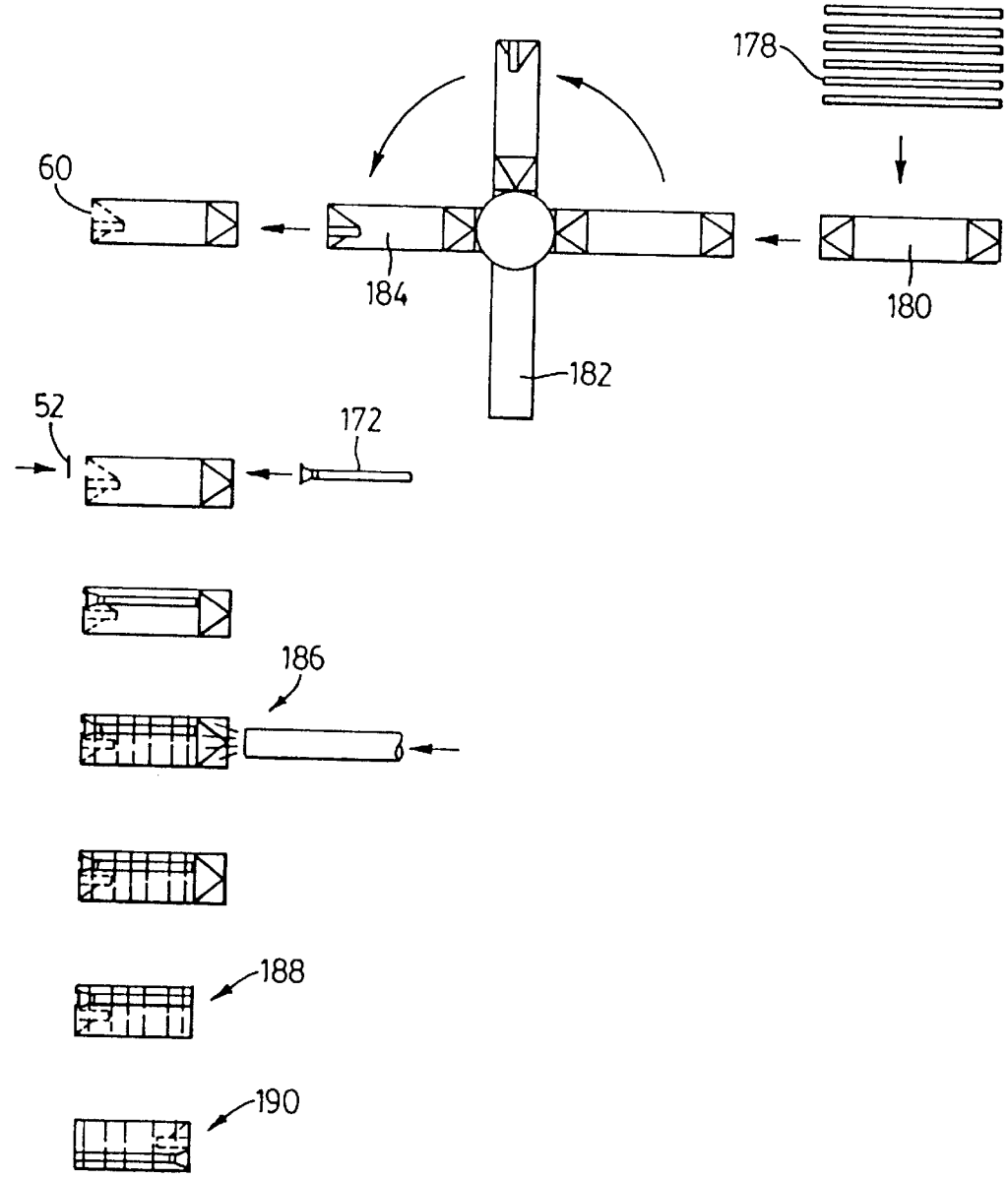
FIG. 38 is a partial sectional view of a sleeve form, fill and seal process of the present invention, showing the attachment of the assembly of FIG. 28 over an opening in the carton, the opening having been already present in the carton top when the carton was in the sleeve form.
Figure 39:
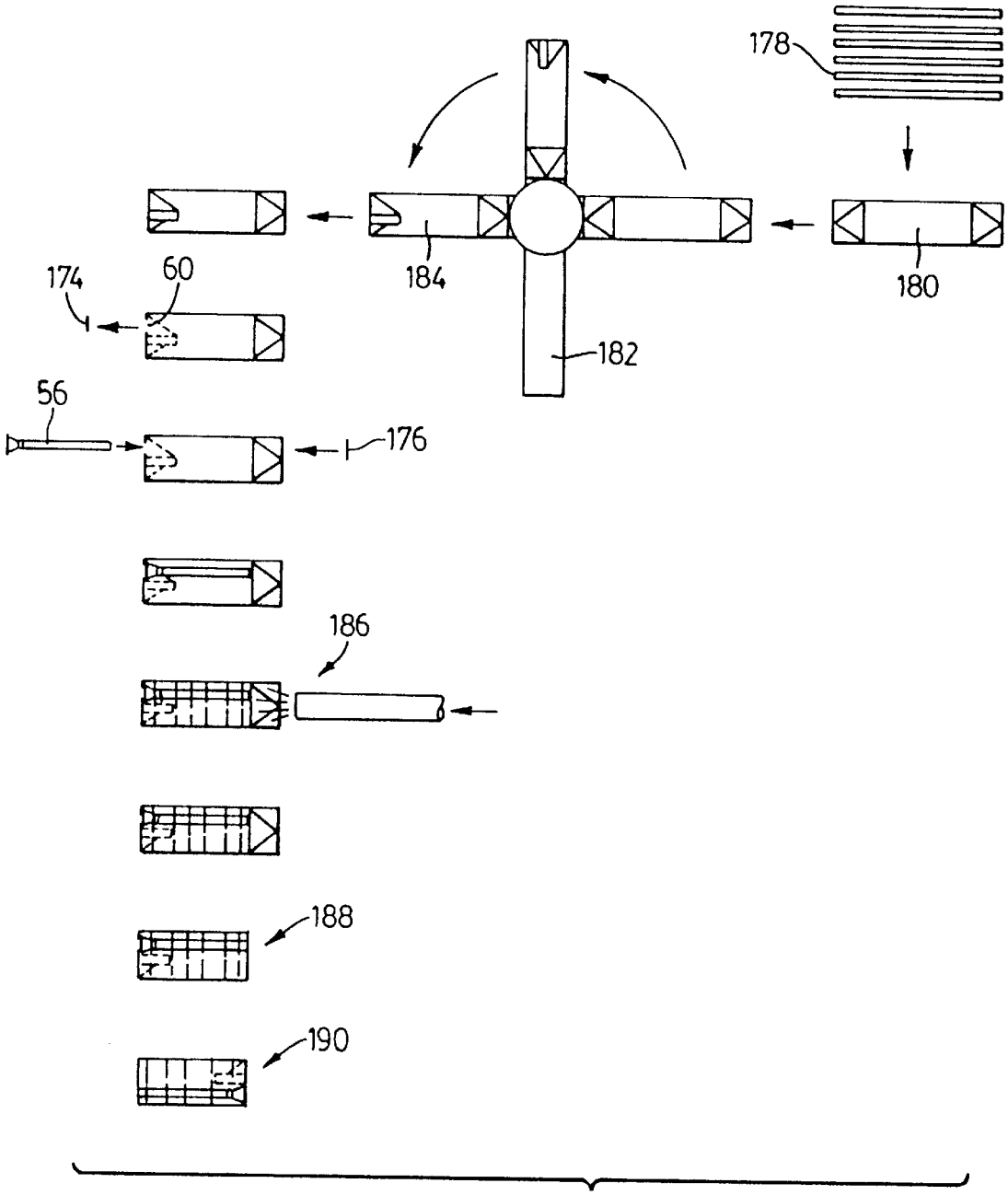
FIG. 39 is a partial sectional view of a sleeve form, fill and seal process of the present invention, showing the attachment of the assembly and seal of FIG. 31 after a hole has been created in the top of the carton.
Figure 40:
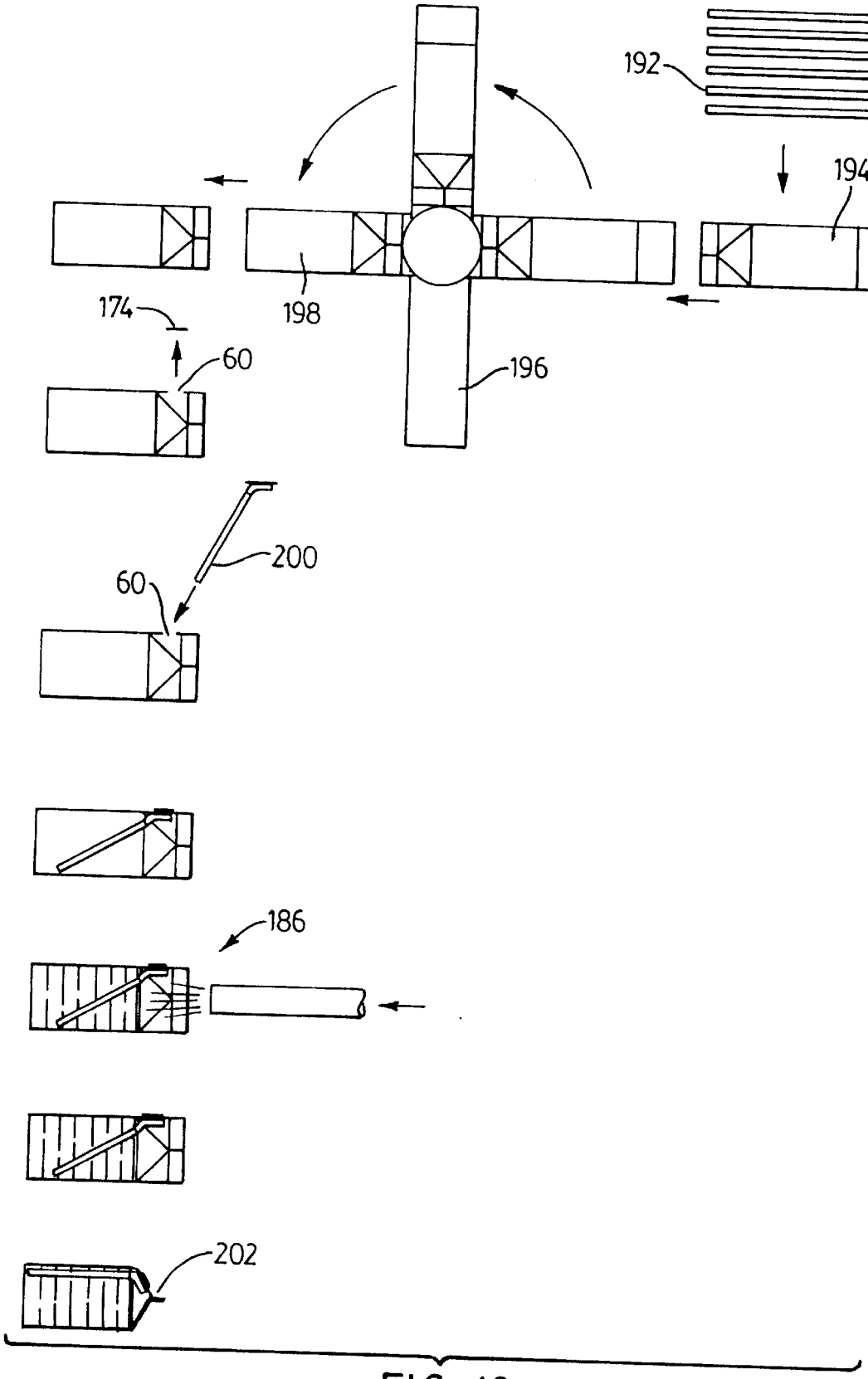
FIG. 40 is a partial sectional view of a gable top sleeve form, fill and seal process of the present invention, showing the attachment of an assembly after a hole has been created in the top of the carton.

A number of variations of the sleeve form, fill and seal process are shown in FIGS. 38, 39 and 40. In FIG. 38 the hole 60 is already cut into sheet packaging material 48 prior to it being formed into a flattened sleeve 178. As described above and shown in FIG. 32 with regard to the form, fill and seal process assembly 56 can be applied to the outside of the carton as shown in FIG. 39 wherein assembly 56 and inner seal 176 are attached on either side of hole 60. Assembly 56 is applied to the outside of the carton and inner seal 176 is applied to the inside of the carton.

The manufacture of gable top cartons can also be adapted to include a straw assembly. Referring to FIG. 40 a process similar to that for the sleeve form, fill and seal process for a parallelepipedic carton is shown for gable top cartons. The gable beverage carton sleeves start out as flattened parallelogram gable sleeves 192 that have been sealed along their longitudinal seams, where they are raised into a sleeve form 194, slid onto a gable mandrel 196, has its bottom end closed, sealed and resulting tabs folded and secured to the bottom of the carton 198. The carton then has a hole 60 cut in the top of the carton and the waste portion 174 is then removed. Assembly 200 is then attached to the outside of hole 60. The carton is then filled with beverage 186, the top of the carton is closed and sealed. The assembly 200 is in a slanted orientation when initially installed in the carton, and it is moved into a vertical orientation when the top of the carton is closed and sealed 202.

Figure 41:
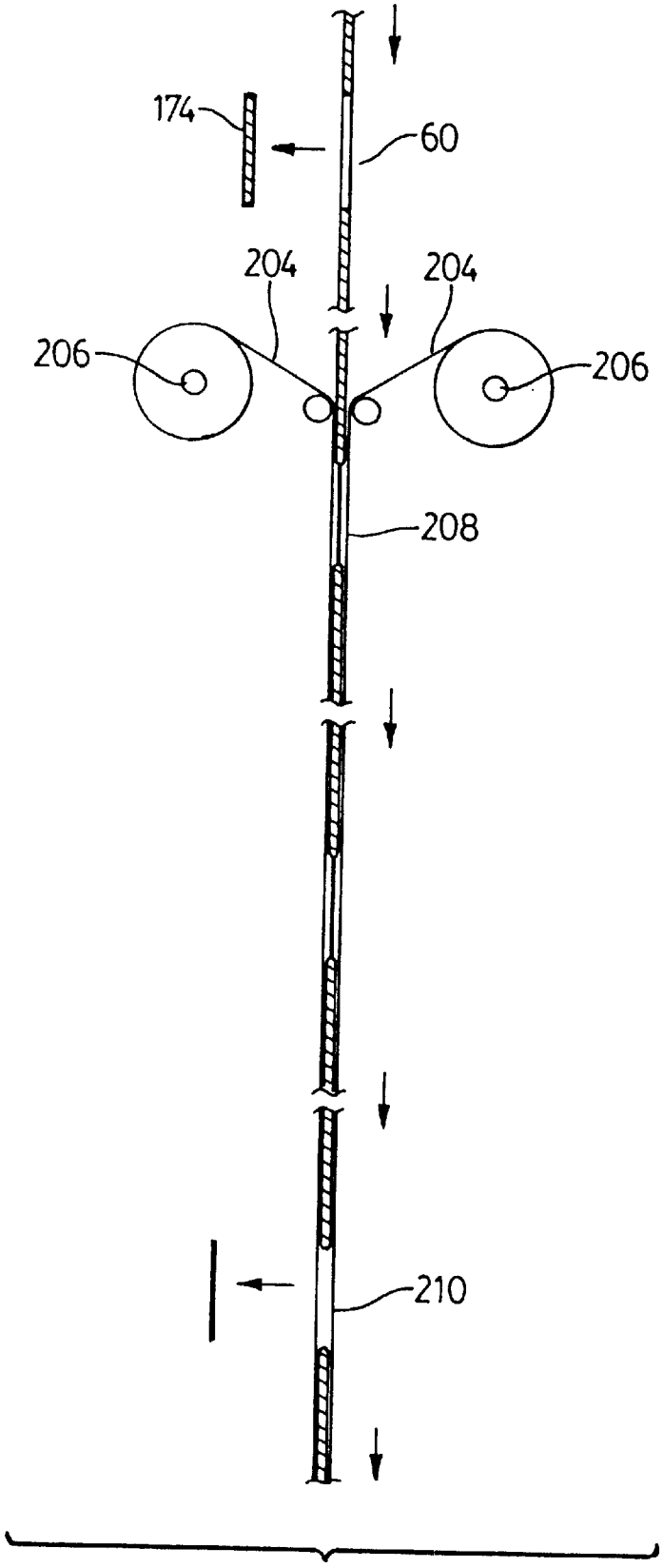
FIG. 41 is a sectional view of an alternative process for sealing the exposed paper board edges around an opening in a plastic laminated paper board sheet packaging material.

FIG. 41 shows a process for manufacturing a plastic laminated sheet packaging material that has holes through the sheet packaging material wherein the holes have edges that are of plastic material. Since it is often a requirement that there be no paper board exposed to the liquid beverage in a beverage package, it may be advantageous to seal the edges of a hole cut through the sheet packaging material in advance of the attachment of any accessories. As shown in sequence in FIG. 41, a paper board sheet packaging material has a hole 60 cut through it and the waste 174 is removed. As the sheet moves, it is laminated on both sides with layers of sheet plastic 204 fed from rolls 206, so that the two layers of plastic weld to each other to form a single layer of plastic that completely seals over the previously cut hole 60. shown at 208. Next, a second smaller hole 210 is cut out from the sealed over hole 208 such that only the plastic layer is cut and such that all parts of the paper board are sealed by a layer of plastic. Plastic laminated sheet packaging material cut and sealed in this manner would allow assemblies to be applied to either side of a hole in the sheet packaging material without considerable attention being given to the requirement of sealing any exposed paper board edges.

It will be appreciated by those skilled in the art that the elements of the assembly 56 shown here as being attached in one step could be attached separately. That is the holder 34 could be attached to sheet material 48 and then the straw 32 inserted therein and then sealing strip 52 attached to the holder 34 or the sheet material 48 and holder 34. Further, it will be appreciated by those skilled in the art that any of the above processes could be adapted such that the hole 60 is cut into the sheet packaging material 48 prior to it being rolled onto real 72 or prior to the formation of flattened parallelogram shapes 178, 192. In addition the hole 60 could be sealed as shown in FIG. 41 thereby eliminating the need for the inner seal 176. Still further, it will be appreciated by those skilled in the art that the unitary straw and holder 198 could be substituted for the straw 32 and holder 34 in any of the above described processes.

It will be appreciated that the above description related to the invention by way of example only. Many variations on the invention will be obvious to those skilled in the art and such obvious variations are within the scope of the invention as described herein whether or not expressly described.

What is claimed as the invention is:

1. A process for attaching a holder and straw assembly including a straw portion to a carton in a continuous form, fill and seal process comprising the steps of:

unrolling a rolled sheet material being comprised of a plurality of carton sections, each carton section having a hole formed therein;

sealingly attaching the holder and straw assembly to the sheet material over said hole; such that the straw portion extends inside the sleeve attaching a strip to the holder and straw assembly;

forming the sheet into a columnar sleeve;

sealing a longitudinal seal along the columnar sleeve;

adding the beverage into the sealed columnar sleeve;

forming a top and bottom transverse seal across the columnar sleeve and through the beverage;

cutting each carton from the columnar sleeve; and forming a parallelepipedic carton having a drinking straw therein.

2. A form fill and sealing process as claimed in claim 1 further including the step of moving a straw of an attached straw and holder assembly to adjacent to the rolled sheet material.

3. A form fill and sealing process as claimed in claim 1 further including the step of inserting a straw in a holder to form a straw/holder assembly.

4. A form fill and sealing process as claimed in claim 3 wherein the strip is attached to the holder/straw assembly prior to the holder and straw assembly being attached to the sheet material.

5. A form fill and sealing process as claimed in claim 1 wherein the straw and the holder are integrally attached.

6. A form fill and sealing process as claimed in claim 1 wherein the holder and straw assembly is attached to the inside of the rolled sheet material.

7. A form fill and sealing process as claimed in claim 6 wherein the holder and straw assembly further includes a holder seal that is attached to the holder and straw assembly to hold the straw in a stowed position prior to the holder and straw assembly being attached to the sheet material.

8. A form fill and sealing process as claimed in claim 7 wherein the strip is attached to the outside of the sheet material and attached to the inner seal.

9. A form fill and sealing process as claimed in claim 8 wherein the holder and straw assembly and the strip are attached in the same step.

10. A form fill and sealing process as claimed in claim 8 further including the step of cutting the hole in the sheet material.

11. A form fill and sealing process as claimed in claim 10 wherein the hole is cut and the holder and straw assembly is attached in the same step.

12. A form fill and sealing process as claimed in claim 1 wherein the holder and straw assembly is attached to the outside of the sheet material and the holder and straw extends through the hole to the inside of the sheet material.

13. A form fill and sealing process as claimed in claim 12 wherein the strip is attached to the holder and straw assembly prior to attachment to the sheet material.

14. A form fill and sealing process as claimed in claim 13 further including an inner seal attached to the inside of the sheet material proximate to the hole thereby sealing the edges of the hole.

15. A form fill and sealing process as claimed in claim 14 wherein the holder and straw assembly and the inner seal are attached in the same step.

16. A form fill and sealing process as claimed in claim 14 further including the step of cutting the hole in the sheet material.

17. A form fill and sealing process as claimed in claim 16 wherein the hole is cut and the holder and straw assembly is attached in the same step.

18. A process for attaching a holder and straw assembly to a carton in a sleeve form, fill and seal process comprising the steps of;

receiving a flattened sleeve;

expanding the sleeve having a hole formed therein;

sealing one end of the sleeve;

sealingly attaching the holder and straw assembly to the sleeve over said hole;

attaching a strip to the holder and straw assembly;

adding the beverage into the sealed columnar sleeve;

sealing the other end of the sleeve; and forming a carton having a drinking straw therein extending from one end thereof.

19. A sleeve form and sealing process as claimed in claim 18 further including the step of inserting a straw in a holder to form holder and assembly.

20. A sleeve form and sealing process as claimed in claim 19 wherein the strip is attached to the holder and straw assembly prior to the holder and straw assembly being attached to the sleeve.

21. A sleeve form and sealing process as claimed in claim 18 wherein the straw and the holder are integrally attached.

22. A sleeve form and sealing process as claimed in claim 18 wherein the holder and straw assembly is attached to the inside of the sleeve.

23. A sleeve form and sealing process as claimed in claim 22 wherein the holder and straw assembly further includes a holder seal that is attached to the holder and straw assembly to hold the straw in a stowed position prior to the holder and straw assembly being attached to the sleeve.

24. A sleeve form and sealing process as claimed in claim 23 wherein the strip is attached to the outside of the sleeve and attached to the inner seal.

25. A sleeve form and sealing process as claimed in claim 24 wherein the holder and straw assembly and the strip are attached in the same step.

26. A sleeve form and sealing process as claimed in claim 25 further including the step of cutting the hole in the sleeve.

27. A sleeve form and sealing process as claimed in claim 26 wherein the hole is cut and the holder and straw assembly is attached in the same step.

28. A sleeve form and sealing process as claimed in claim 18 wherein the holder and straw assembly is attached to the outside of the sleeve and the holder and straw extends through the hole to the inside of the sleeve.

29. A sleeve form and sealing process as claimed in claim 28 wherein the strip is attached to the holder and straw assembly prior to attachment to the sleeve.

30. A sleeve form and sealing process as claimed in claim 29 further including an inner seal attached to the inside of the sleeve proximate to the hole thereby sealing the edges of the hole.

31. A sleeve form and sealing process as claimed in claim 30 wherein the holder straw assembly and the inner seal are attached in the same step.

32. A sleeve form and sealing process as claimed in claim 31 further including the step of cutting the hole in the sleeve.

33. A sleeve form and sealing process as claimed in claim 32 wherein the hole is cut and the holder and straw assembly is attached in the same step.

34. A sleeve form and sealing process as claimed in claim 18 wherein the carton is a parallelepipedic type carton.

35. A sleeve form and sealing process as claimed in claim 18 wherein the carton is a gable top type carton.

* * * * *